US005700096A

United States Patent [19]

Satoh et al.

[11] Patent Number: 5,700,096

[45] Date of Patent: Dec. 23, 1997

[54] PRINTER AND METHOD OF PRINTING USING THE SAME

[75] Inventors: Mitsuyoshi Satoh; Hideo Numabe; Hideaki Matsuda, all of Miyagi-ken, Japan

[73] Assignee: Tohoku Ricoh Co., Ltd., Miyagi-ken, Japan

[21] Appl. No.: 187,344

[22] Filed: Jan. 26, 1994

[30] Foreign Application Priority Data

Jan. 29, 1993 [JP] Japan ..... 5-013553
Apr. 15, 1993 [JP] Japan ..... 5-088848

[51] Int. Cl.[6] ..... B41J 33/44

[52] U.S. Cl. ..... 400/225; 400/232

[58] Field of Search ..... 400/223, 225, 400/226, 230, 231, 232, 244, 249

[56] References Cited

U.S. PATENT DOCUMENTS

| | | | |
|---|---|---|---|
| 3,665,855 | 5/1972 | Nikoloff | 400/230 |
| 4,496,955 | 1/1985 | Maeyama | 400/239 |
| 4,735,519 | 4/1988 | Tanaka | 400/240.3 |
| 5,181,788 | 1/1993 | Virman et al. | 400/225 |

FOREIGN PATENT DOCUMENTS

| | | | |
|---|---|---|---|
| 31484 | 3/1983 | Japan | 400/54 |
| 102471 | 3/1988 | Japan | 400/54 |
| 3-46310 | 7/1991 | Japan . | |

OTHER PUBLICATIONS

Abstract of JP 3-145-074, Jun. 17, 1988.

*Primary Examiner*—Edgar S. Burr
*Assistant Examiner*—Steven S. Kelley
*Attorney, Agent, or Firm*—Armstrong, Westerman, Hattori, McLeland & Naughton

[57] ABSTRACT

In a printer for printing on a recording medium using a transfer medium, a transfer medium capable of being repeatedly used at the same portion thereof (e.g., a multi-pass thermal transfer ribbon) is conveyed in the normal direction in performing the printing process by a recording means such as a thermal head etc. and the conveying amount of the transfer medium which is used for printing is measured at that time. The transfer medium is conveyed in the reverse direction by a given amount based on the result of the measurement and the reverse direction conveying ratio of the transfer medium to the used length of the transfer medium which is arbitrarily set by a transfer medium reverse direction conveying ratio setting means irrespective of the used amount of the transfer medium every time a unit of printing is completed. Thereafter the transfer medium is conveyed in the normal direction for printing. Repeating these processes, it is possible to use up the transfer medium so far as it is can be practically used for printing.

18 Claims, 19 Drawing Sheets

PRINTER AND METHOD OF PRINTING USING THE SAME

FIELD OF THE INVENTION

The present invention relates to a printer for printing on a recording medium using a transfer medium such as a multi-pass thermal transfer ribbon etc. which can be repeatedly used several times for printing.

DESCRIPTION OF PRIOR ART

There has been recently developed a multi-pass thermal transfer ribbon which can be repeatedly used at the previously used portions thereof for printing as a thermal transfer type ink ribbon (referred to simply as a ribbon hereinafter) serving as a transfer medium.

Such a multi-pass thermal transfer ribbon the repeated use of which has been made possible so far as several times by subjecting the same to a special process is superior in economy to conventional normal single-pass thermal transfer ribbons which have to be thrown away after a single pass for printing since the former can be reused, and the former is also favorable from an ecological point of view.

Now, printing by way of a conventional thermal printer using such a multi-pass thermal transfer ribbon requires the following steps At first, a roll of multi-pass thermal transfer ribbon is set to a ribbon supply spool and one end thereof is pulled out and passed between a thermal head and a platen to be fixed to a ribbon take-up spool.

Then the multi-pass thermal transfer ribbon is gradually rolled about the ribbon take-up spool while being conveyed in one direction in synchronism with printing operation. Upon completion of rolling the whole thermal transfer ribbon onto the ribbon take-up spool, the rolled ribbon is removed from the ribbon take-up spool and is set onto the ribbon supply spool again for repeating similar printing operation.

The reusing the same multi-pass thermal transfer ribbon which has been used for printing once by removing the same form the ribbon take-up spool to reset the same to the ribbon supply spool, however, causes a problem that a still sufficiently usable ribbon cannot be used any more when the same is not rolled up neatly, although it is economical to make full use of the ribbon.

For example, if the ribbon 27 is gradually shifted toward one side of the spool as it is rolled up to form a conical portion 27*a* upon completion of take-up as illustrated in FIG. 20*b* instead of being neatly rolled up as illustrated in FIG. 20*a* and the thus irregularly rolled up ribbon is reused, it meanders to form furrows therein or finally forms a more conical baggy roll so that it is no longer usable.

Also it is liable to be rolled up loosely or sometimes with wrinkles therein.

Moreover, it is difficult to decide the time of renewal since even the multi-pass thermal transfer ribbon is gradually reduced in printing density as it is used repeatedly so that the practically usable frequency thereof cannot be known without actually using it for printing.

As a result, the frequency of repeated use has to be recorded every time the ribbon is reset onto the ribbon supply spool for reuse in order to maintain the printing quality always above a given level.

Accordingly, it is troublesome to use the multi-pass thermal transfer ribbon in such conventional printers.

Furthermore, when the ribbon is broken when it is rolled up to some extent, it is divided into two portions, both of which are still in a usable state.

In this case, either of the two divided ribbons is usually used for further printing, but the reused ribbon is shorter than before and is used up comparatively earlier, which causes oftener ribbon resetting to make the handling thereof troublesome. Moreover, the other piece of ribbon has to be kept in the meantime for later use without fail to make full use of the ribbon.

Even if the ribbon is not broken, the amount of the ribbon which is set onto the ribbon supply spool is previously determined by a space for accommodating the ribbon therein, the ribbon on the ribbon supply spool is used up at the midway of printing before it is completed in case a large amount of printing is continuously performed.

In such a case, there is a problem that the rolled up ribbon has to be reset onto the ribbon supply spool, which reduces work efficiency since it cannot be performed by automation.

SUMMARY OF THE INVENTION

The present invention has been made in view of the above problems in a printer for printing on a recording medium using such a transfer medium and a first object thereof is to make full use of the transfer medium such as a ribbon etc. still capable of printing (recording) without throwing away the same.

It is a second object of the invention to be free from repeatedly resetting the transfer medium, from recording the frequency of using the same and from minding the time of renewal of the same after the same is once set.

It is a third object of the invention that the transfer medium on the take-up side is not wastefully abandoned in case the transfer medium is broken when it is rolled up to some extent.

It is a fourth object of the invention to perform the whole printing by a transfer medium once set without resetting the same even in case of continuously performing a large amount of printing.

It is a fifth object of the invention to set the allowable limit of print quality such as print density, blur, etc., before regular printing starts so as to always maintain a print quality above a primarily set level without verifying printed letters each time after the printing starts.

It is a sixth object of the invention to prevent symbols such as a bar code printing on a recording medium by a recording means from being unreadable or from misreading.

It is a seventh object of the invention to let an operator to clearly recognize a defective portion in a recorded content by his eyes and journalize the same in case there is a defect in the recorded content.

It is an eighth object of the invention to avoid waste in the recording medium by preventing a portion of the recording medium from being instantly recognized as a defect portion even if there is a very small void or spot on a scanning path when the recorded data is read out by an electro-optical technology and the void or spot is detected as a defect thereby.

It is a ninth object of the invention to dispense with recording the recorded content including a defectively recorded symbol again upon completion of a series of recording in case the recording medium is defectively recorded due to a local defect of a wrinkle etc. in a transfer medium such as the ribbon etc.

It is a tenth object of the invention to recognize a defective recording of a recording medium due to constant wrinkles in a transfer medium such as the ribbon etc. or other factors except the transfer medium so as to remove the defective portion of the recording medium.

It is an eleventh object of the invention to prevent the conveying speed of the transfer medium from being so inadequate as to make the recorded content defective and further compensate the conveying speed of the transfer medium automatically to be a maximal speed at which no defect is detected in the recorded content.

It is a twelfth object of the invention to make the portion of the recording medium in which a defect is detected easily recognizable later with the cause thereof.

In order to attain the above objects, the invention provides a printer as set forth above comprising a recording means for recording on a recording medium by supplying energy to a transfer medium, a transfer medium reversely conveying amount information management means for managing the conveying amount information of the transfer medium in the direction reverse to the normal direction toward the recording means and a transfer medium conveying means which can convey the transfer medium in the normal direction and reverse direction and conveys the transfer medium based on the reversely conveying amount information managed by the above transfer medium reversely conveying amount information management means in case the transfer medium is conveyed in the reverse direction.

The invention also provides a method of printing which repeats the steps of performing a given length of printing on the recording medium which is conveyed in the normal direction by the above printing means while conveying the transfer medium in the same direction by the above transfer medium conveying means, then conveying the transfer medium in the reverse direction by the transfer medium conveying means based on the reversely conveying amount information managed by the above transfer medium reversely conveying amount information management means and thereafter performing a given length of printing on the recording medium while conveying the transfer medium in the normal direction again.

It is possible to repeatedly use a transfer medium up to the limit of use by setting the same to a ribbon supply spool only once in such a printer according to the method of printing using the same, since the reverse direction (the direction reverse to the normal direction toward the recording means) conveying amount information of the transfer medium is managed by the transfer medium reversely conveying amount information management means and the transfer medium is conveyed in the reverse direction set forth above by some percentage of the length of the transfer medium used for printing the given length of recording (printing) based on the management information every time the given length of recording is completed and thereafter the transfer medium is conveyed in the normal direction again for repeatedly performing next printing.

Accordingly, it is enough to set the transfer medium onto the ribbon supply spool only once instead of troublesome work to resetting the same for reuse after using the same.

Moreover, it is convenient since it is free form recording the frequency of use or from minding the time of exchanging the transfer medium for a new one.

Furthermore, when the transfer medium is broken halfway, the piece of the broken transfer medium which has passed the recording means has already been used up to the limit of use so that it can be thrown away instead of being kept for reuse, which saves the process of management.

Still furthermore, it is recommendable that the transfer medium reversely conveying amount information management means is composed of a transfer medium normal direction conveying amount measuring means, a transfer medium reverse direction conveying ratio setting means and a transfer medium reverse direction conveying amount control means.

In that case, the transfer medium normal direction conveying amount measuring means measures the conveying amount of the transfer medium which is conveyed in the normal direction for printing when the recording medium performs the recording process and the transfer medium reverse direction conveying amount control means can control the conveying amount of the transfer medium in the reverse direction set forth above based on the result of the measurement and a ratio of reverse direction conveying amount of the transfer medium to the used length thereof for a unit of printing which is arbitrarily set by the transfer medium reverse direction conveying ratio setting means.

As a result, it is possible to use the transfer medium again for printing by conveying the same in the reverse direction by a given amount arbitrarily set by a user every time a given length of recording is completed irrespective of the used amount of the transfer medium.

It is recommendable that the transfer medium normal direction conveying amount measuring means is composed of a transfer medium supply spool rotating amount measuring means for measuring the rotating amount of the transfer medium supply spool or the rotating amount of a member interlocking with the same.

Then it is possible to measure the rotating amount thereof only during the given length of recording and control the reverse direction conveying amount of the transfer medium at a reverse direction conveying ratio which is arbitrarily set by the transfer medium reverse direction conveying ratio setting means based on the result of measurement.

As a result, the transfer medium can be correctly returned toward the ribbon supply spool always by a given amount every time a unit of recording is completed as set forth above irrespective of the remaining amount of the transfer medium on the supply side.

Moreover, if the printer is provided with a test printing means for setting the transfer medium reverse direction conveying ratio, it is possible to thereby perform test printing in advance before the start of a regular printing operation, i.e., repeating the steps of performing a given length of printing on a recording medium by the recording means and conveying the transfer medium in the reverse direction at a given ratio to the given length every time.

When the test printing is performed on several sheets of recording medium, printing is performed on the first sheet using the transfer medium which is in an entirely unused state, and on the following sheets using the transfer medium which is increased in the frequency of repeated use in the printing order.

As a result, it is possible to previously decide how many times the transfer medium can be used based on the result of the test printing, so that the transfer medium reverse direction conveying ratio can be set by the transfer medium reverse direction conveying ratio setting means so as to obtain a high printing quality.

It is recommendable that the printer is equipped with a verifying means for verifying the recorded contents of the symbols such as the bar codes etc. recorded on the recording medium and an invalid index forming means for forming an invalid index on the recording medium by printing etc. when the verifying means detects a defectively recorded content in case the printer as set forth above is equipped with a recording means for printing symbols such as bar codes etc.

In that case, the verifying means set forth above can instantly verify whether there are defective portions or not in the symbols such as the bar codes which are recorded on the recording medium by the recording means.

When the verifying means detects a defect in the recorded content of a symbol etc., the invalid index forming means forms an invalid index on the recording medium by printing etc., so that an operator can clearly locate the defectively recorded portion at a glance to remove it.

If the verifying means comprises a re-verifying means for verifying the same recorded content again changing a scanning path when the verifying means detects a very small void or spot which is positioned on the scanning path thereof so that the verifying means decides that the recorded content is defective, the re-verifying means sometimes does not detect it since the scanning path is changed.

As a result, a symbol having a recorded content which is sufficiently readable by an electro-optical technology is not regarded as a defective data, so that the recording medium can be prevented from being wasted.

Moreover, it is recommendable that the recording means is provided with a re-recording means for recording the same symbol again in the succeeding recording portion on the recording medium when the verifying means detects a defect in the recorded content as a result of verifying.

In that case, since the same symbol is recorded in the succeeding recording portion of the recording medium in case a defectively recorded content is detected by verifying, a symbol which is defectively recorded need not be recorded again upon completion of a series of recording operation in case wrinkles etc. in the transfer medium such as a ribbon and the like cause a local defect therein which results in the defective recording of the recording medium, so that it is timesaving.

Furthermore, it is recommendable that the transfer medium conveying means is provided with a transfer medium normal direction conveying re-recording control means for stopping the conveyance of the transfer medium in the reverse direction based on the reversely conveying amount information of the transfer medium reversely conveying amount information management means when the verifying means detects a defect in the recorded content as a result of verifying and conveying the transfer medium only in the normal direction to print the same symbol in the succeeding recording portion of the recording medium by the recording means.

In that case, the same symbol is recorded again in the succeeding recording portion of the recording medium by way of the portion of the transfer medium which is not used yet by stopping the conveyance of the transfer medium in the reverse direction and conveying the same in the normal direction alone when the verifying means detects a defect in the recorded content as a result of verifying.

Accordingly, when a defect is detected in the recorded content as a result of verifying, it proves that there are constant wrinkles in the transfer medium such as a ribbon etc. or a defect due to a factor excepting the transfer medium.

It is recommendable that the printer is provided with a transfer medium reverse direction conveying amount variation recording control means for reducing the reverse direction conveying amount of the transfer medium which is an information managed by the transfer medium reversely conveying amount information management means when the above verifying means does not detect any defect in the recorded content recorded again by the above transfer medium normal direction conveying re-recording control means so as to convey the above transfer medium in the reverse direction by the varied reverse direction conveying amount by way of the above transfer medium conveying means every time a unit of printing is completed during the normal direction conveyance thereof to print symbols on the succeeding recording medium conveyed thereafter.

In that case, when the verifying means detects no defect in the content recorded again by the transfer medium normal direction conveying re-recording control means, the reverse direction conveying amount of the transfer medium which is an information managed by the transfer medium reversely conveying amount information management means is reduced and symbols are recorded on the succeeding recording medium by conveying the transfer medium in the reverse direction by the reduced reverse direction conveying amount by way of the transfer medium conveying means every time a unit of printing is completed during the normal direction conveyance thereof.

Accordingly, evens if the reverse direction conveying amount of the transfer medium is not set adequately so that a defect is detected in the recorded content, it is possible to make the recorded content undefective in which no defect is detected by reducing the reverse direction conveying amount of the transfer medium.

It is recommendable that the printer is provided with a transfer medium reversely conveying amount gradually reducing adjustment means for repeatedly reducing the reverse direction conveying amount of the transfer medium which is an information managed by the above transfer medium reversely conveying amount information management means until no defect is detected when the verifying means detects a defect in the recorded content of a symbol which is recorded under the control of the transfer medium reverse direction conveying amount variation recording control means.

In that case, if the set value is still inadequate and a defect is detected in the recorded content in spite of the reduction of the above reverse direction conveying amount, the reverse direction conveying amount of the transfer medium is repeatedly reduced until no defect is detected in the recorded content for automatic compensation, so that a recorded content having no defect can be obtained without labor.

It is also recommendable that the printer is provided with an invalid index variation control means for forming an invalid index which is different in shape etc. from the preceding ones on the recording medium by way of the above invalid index forming means when the verifying means detects a defect in the recorded content of a symbol recorded on the recording medium while conveying the transfer medium in the reverse direction by the varied reverse direction conveying amount every time a unit of printing is completed during the normal direction conveyance thereof.

In that case, when a defect is detected in the recorded content of a symbol recorded on the recording medium while conveying the transfer medium in the reverse direction by the varied reverse direction conveying amount every time a unit of printing is completed during the normal direction conveyance thereof, the invalid index formed thereon is different in shape from those formed in the preceding recording medium.

As a result, it is possible to easily recognize the defective portions of the recording medium due to the inadequate setting of the reverse direction conveying amount of the above transfer medium together with the cause thereof by way of the different invalid indices.

The above and other objects, features and advantages of the invention will be apparent from the following detailed description which is to be read in conjunction with the accompanying drawings.

DETAILED DESCRIPTION OF THE PREFERRED EMBODIMENT

Figure 1:
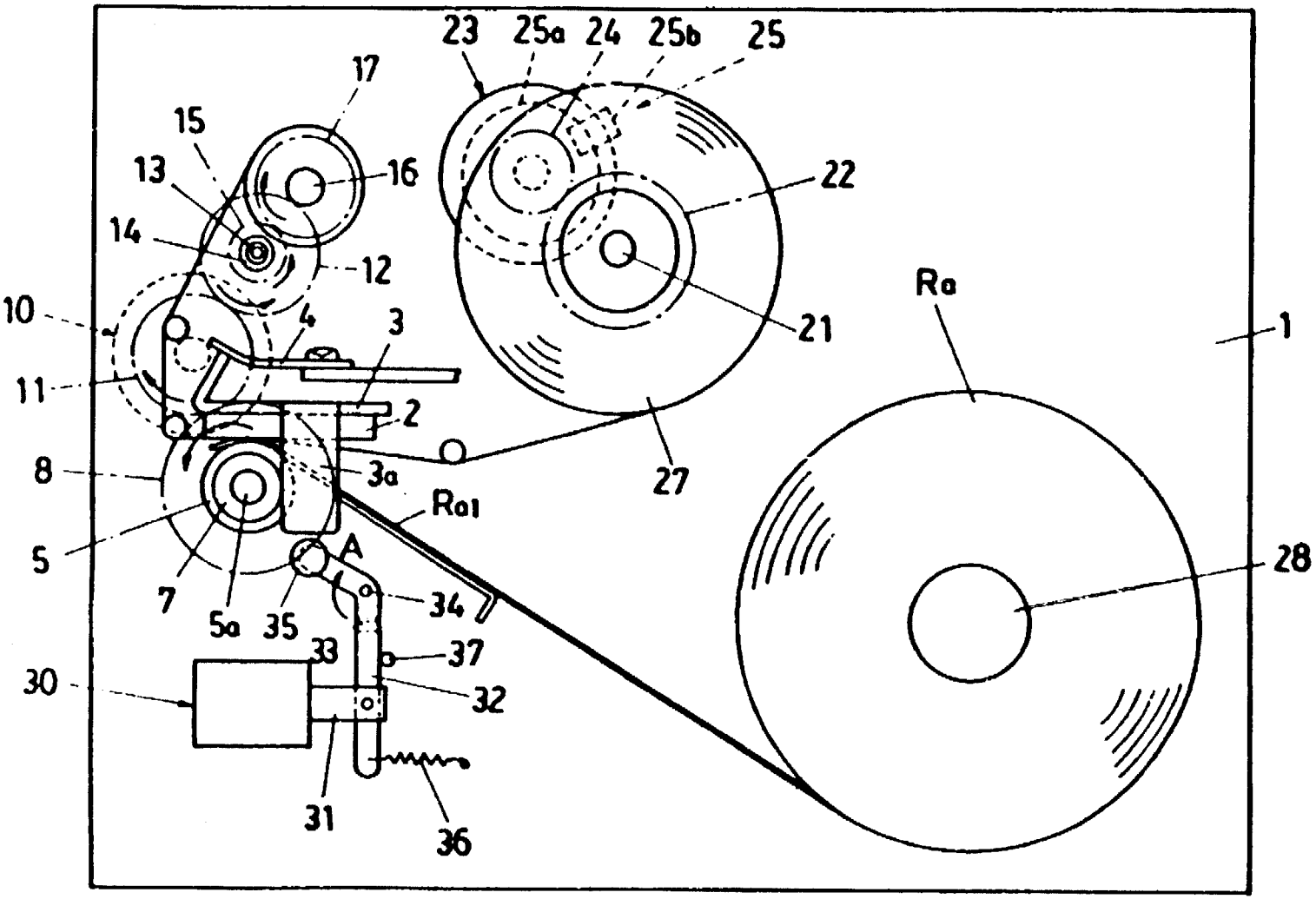
FIGS. 1, 2 and 3 are a view showing the whole arrangement, a left side view and a plan view of a printer according to a first embodiment of the invention.

The embodiments of a printer according to the invention will be described with reference to drawings hereinafter.

First embodiment (FIGS. 1 to 9):

A first embodiment of the invention will be described with reference to FIGS. 1 to 3.

The printer swingably holds a thermal head 2 on a main frame 1 by way of a head holding member, not shown. A holding plate 3 incorporated with the thermal head 2 is forced to press on a platen 5 by a flat spring 4 so as to press the thermal head 2 against the platen 5 by a given pressure.

Figure 2:
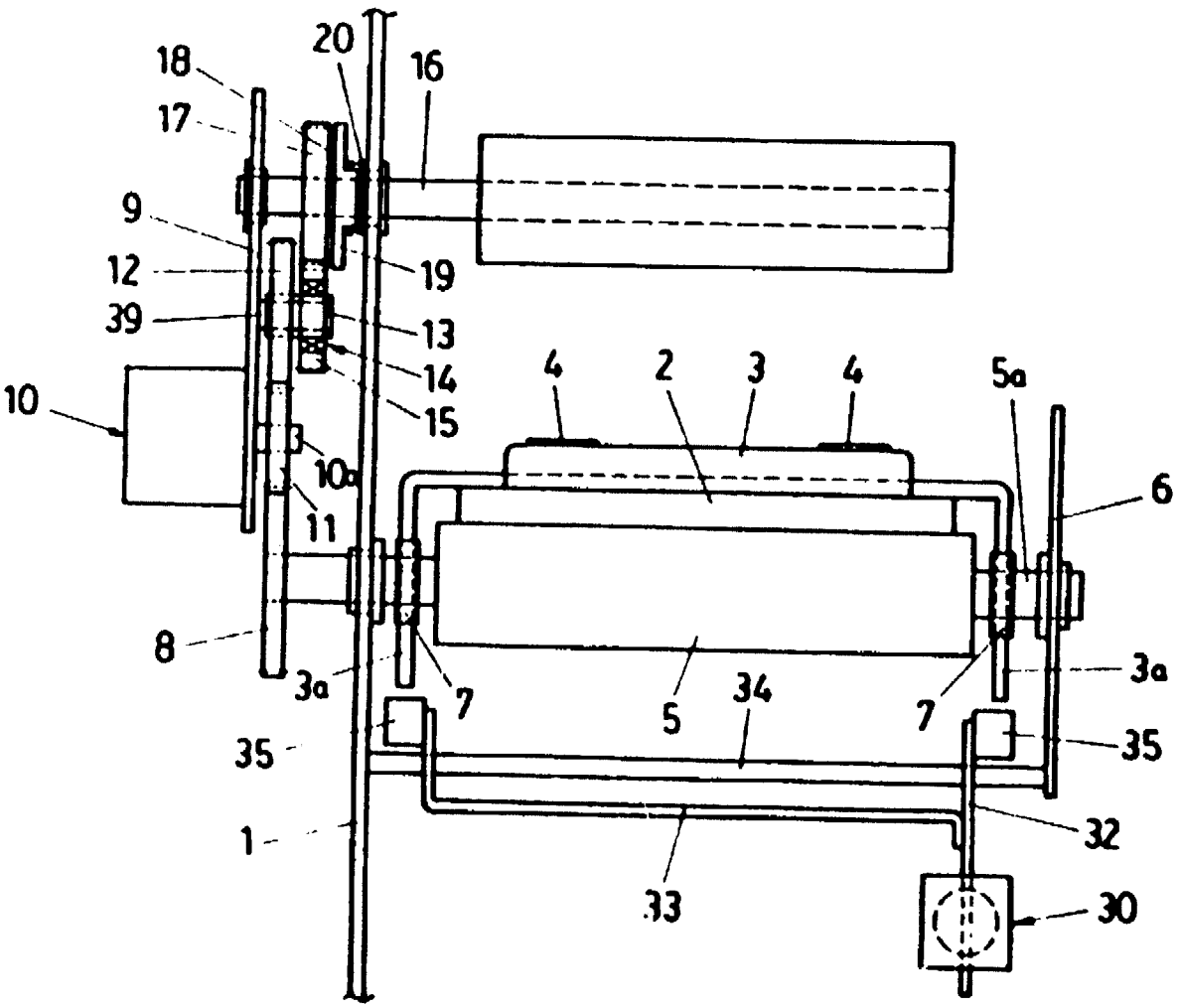

The platen 5 is rotatably supported by the main frame 1 at one end of the shaft 5*a* thereof and by a platen subframe 6 at the other end of the shaft 5*a* thereof by way of bearings as illustrated in FIG. 2. Head positioning collars 7 and 7 are rotatably attached to the both sides of the shaft 5*a* thereof.

A platen gear 8 fixed to one side of the shaft 5*a* (on the left side in FIG. 2) engages with a motor gear 11 fixed to the shaft 10*a* of a motor 10. The motor 10 is fixed to a motor subframe 9.

The motor gear 11 engages with a gear 12 united with a sleeve 13, which is rotatably fitted onto a shaft 39 fixed to the motor subframe 9.

A gear 15 is attached to the portion of the sleeve 13 which projects from the gear 12 around the outer periphery thereof by way of a one-way clutch forced inside the gear 15. The gear 15 engages with a gear 17, which is rotatably attached to a ribbon take-up spool 16 which is rotatably supported by the main frame 1 and the motor subframe 9 by way of bearings.

A friction member 18 is fixed to the right side surface of the gear 17 in FIG. 2. A disc 19 having a stepped portion is attached to the ribbon take-up spool 16 on the right side of the friction member 18 in such a way as to be unrotatable relative to the ribbon take-up spool 16 and movable only in the axial direction (right and left direction in FIG. 2) of the ribbon take-up spool 16.

These three are pressed against one another by the biasing force of a compressed coil spring 20.

As a result, the rotating force of the gear 17 is transmitted to the disc 19 by way of the friction member 18 so that the ribbon take-up spool 16 rotates to roll a multi-pass thermal transfer ribbon (referred to simply as a ribbon hereinafter) 27 round it is illustrated in FIG. 1.

The multi-pass thermal transfer ribbon 27 can be repeatedly used for printing by being subjected to a specific processing.

The arrows attached to the gears in FIG. 1 indicate the rotating direction of the gears when a recording medium label Ra is discharged and the ribbon 27 is rolled round the ribbon take-up spool 16.

When they rotate in the directions indicated by the arrows, the sleeve 13 is interlocked with the one-way clutch 14 so that the motor gear 11 and the gears 12, 15 and 17, i.e., all the gear system relating to taking up the ribbon and the disc 19 rotate so that the ribbon take-up spool 16 rotates in the direction of the arrow.

On the other hand, in case the ribbon take-up spool 16 is rotated in the direction reverse to that of the arrow in FIG. 1 which is the direction for returning the rolled up ribbon 27, the ribbon take-up spool 16 and the disc 19 rotate against the friction of the gear 17 and the friction member 18 even if the motor 10 is held not to rotate by a minute current.

As a result, the ribbon 27 is rolled back round the ribbon supply spool 21 by the rotating force of a motor 23 for winding back the ribbon.

The one-way clutch 14 functions to shut off the transmission of rotation of the motor 10 in case the labels alone are conveyed reversely by separating the thermal head 2 from the platen 5 or the label and ribbon are reversely conveyed together while being clamped between the thermal head 2 and the platen 5 in the printer which drives the platen 5 and the ribbon take-up spool by the motor 10 as described in this embodiment, so that the one-way clutch 14 is not necessary in case such a control of reversely conveying the labels is not required.

Figure 3:
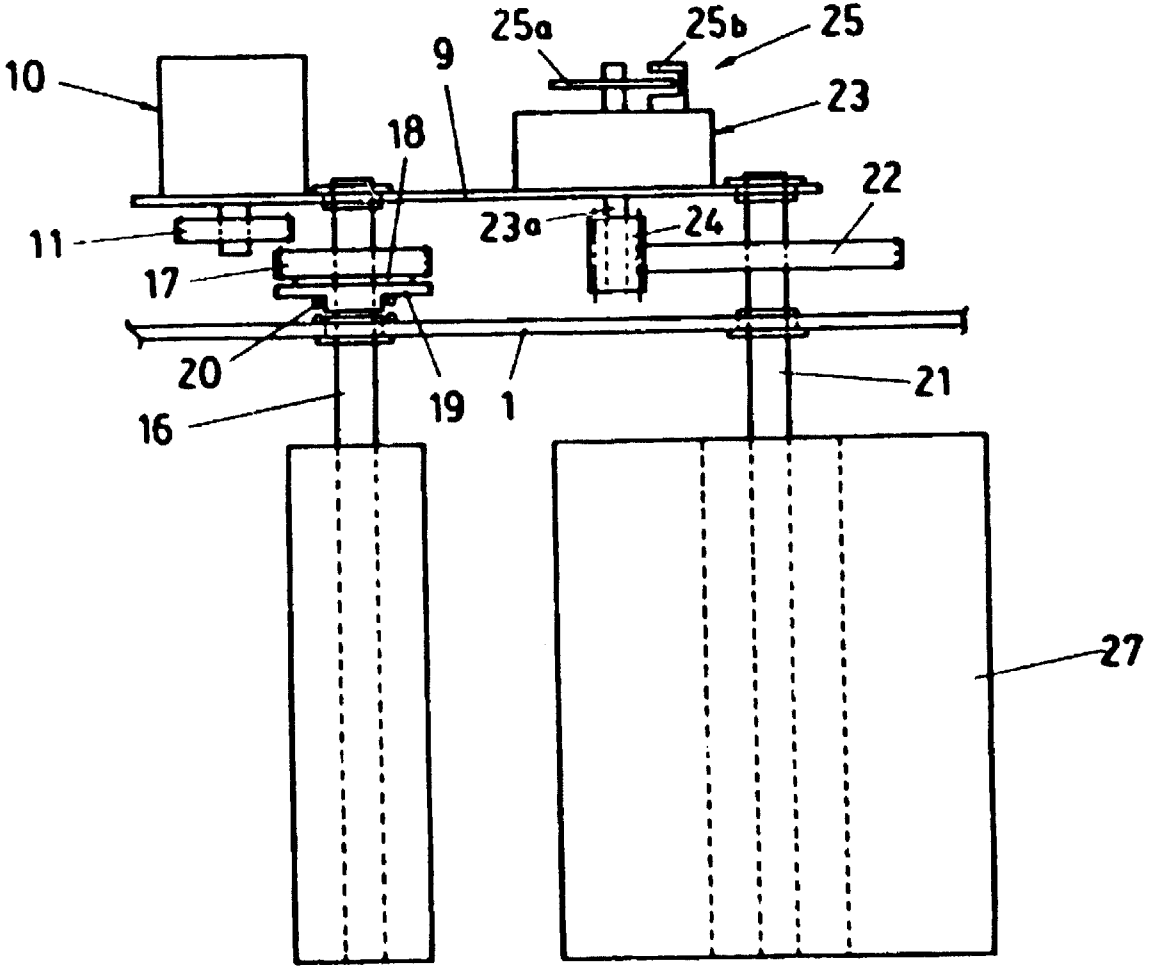

The ribbon supply spool 21 is rotatably supported by the main frame 1 and the motor subframe 9 by way of bearings as illustrated in FIG. 3 wherein a connecting mechanism between the motor gear 11 and the gear 17 is not shown, and a gear 22 is fixed the portion of to the ribbon supply spool 21 between the main frame 1 and the motor subframe 9.

The gear 22*a* engages with a gear 24 fixed to a shaft 23*a* of the motor 23 at the lower side thereof for winding back the ribbon, and the motor 23 is fixed to a motor subframe 9.

The slit disc 25*a* of an encoder 25 is fixed to the other side of the shaft 23*a* and the sensor portion 25*b* of the encoder 25 which serves as a photosensor is provided at the position where slits formed on the outer periphery of the slit disc 25*a* pass for counting the encoder pulses.

On the other hand, a head holding plate 3 for fixedly holding the thermal head 2 has leg portions 3*a* and 3*g* which are formed by bending the holding plate 3 downward at right angles at both ends thereof as illustrated in FIG. 2. The left side edge of each leg portion 3*a* is struck against the outer periphery of each head positioning collar 7 in FIG. 1 to determine the right and left position of the thermal head 2 relative to the platen 5 in the figure.

A mechanism for lifting the thermal head 2 to separate the same from the platen 5 is provided under the leg portions 3*a* of the head holding plate 3.

The mechanism comprises a laminar arm 32 and an arm 33 extending under the platen 5 with one end thereof fixed to the substantially central portion of the laminar arm 32 and with the other end thereof under the leg portion 3*a* of the head holding plate 3 on the side of the main frame 1 as illustrated in FIG. 2. A columnar boss 35 is attached to the side of the tip end of the other end of the arm 33 and also the other columnar boss 35 is similarly attached to the side of the upper end of the arm 32 so as to face the leg portion 3*a* on the right side in the figure.

The arms 32 and 33 are fixed to a shaft 34 laid between the main frame 1 and the platen subframe 6 so as to be rotatable about the shaft 34 therewith in the direction of the arrow A in FIG. 1.

A coil spring 36 is attached to the lower end of the arm 32 for forcing the same to turn in the direction reverse to that of the arrow A together with the arm 33 until the same is stopped at the position to be in contact with a turning amount control pin 37 as illustrated in FIG. 1.

The plunger of a DC solenoid 30 for lifting the thermal head 2 to separate the same from the platen 5 is attached to the arm 32 at the portion thereof above the portion to which the coil spring 36 is attached.

When the DC solenoid 30 is energized, the plunger 31 is contracted so as to turn the arm 32 in the direction of the arrow A against the resilience of the coil spring 36 together with the arm 33 in FIG. 1.

When the DC solenoid 30 is in an inactive state, each boss at the side of the tip end of the arms 32 and 33 is positioned right under each of the leg portions 3*a* and 3*a* on both sides of the head holding plate 3 to be apart therefrom a little (also refer to FIG. 2).

In case of using the printer, the ribbon 27 wound around a supply core is set onto the ribbon supply spool 21 and the take-out end of the ribbon 27 is passed between the thermal head 2 and the platen 5 to be wound round a take-up core set on a ribbon take-up spool 16.

Also a similarly rolled up recording medium label Ra is set onto a label supply spool 28 and the take-out end thereof is drawn as far as between the thermal head 2 and the platen 5 to be clamped thereby. The recording medium may be papers such as tickets, tags, etc. instead of the above labels Ra.

When printing (recording) on a first label Ra1 starts in this state, the encoder 25 starts counting pulses instantly.

Figure 4:
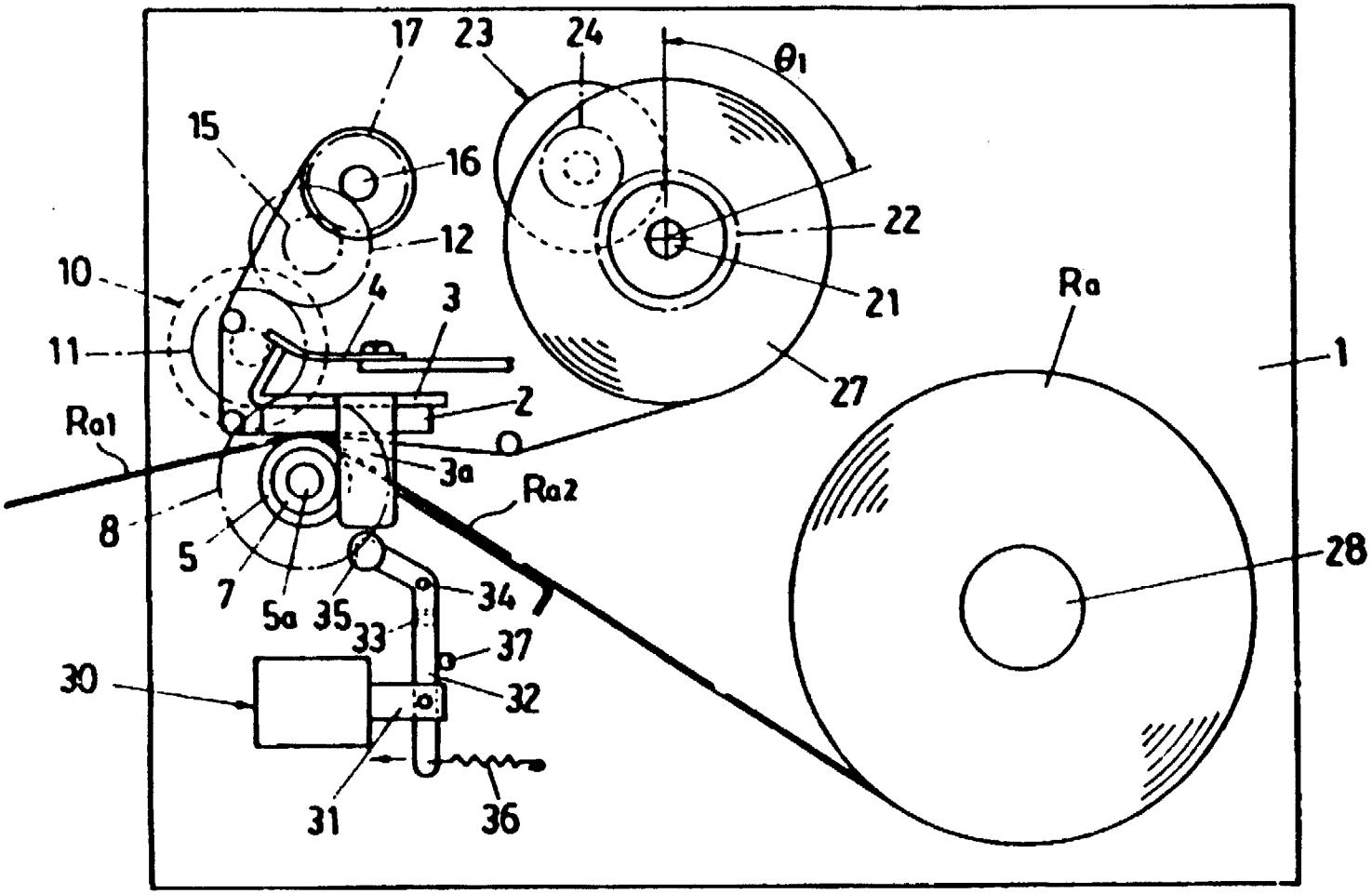
FIG. 4 is a schematic view of the printer in FIG. 1 which has printed a first label Ra1.

When printing on the first label Ra1 is finished, counting the pulses is completed as illustrated in FIG. 4.

The number of pulses n1 counted during this time can be used for representing the amount of ribbon 27 used for printing on the first label, i.e., the angle of rotation θ1 of the ribbon supply spool 21 during the printing.

Figure 5:
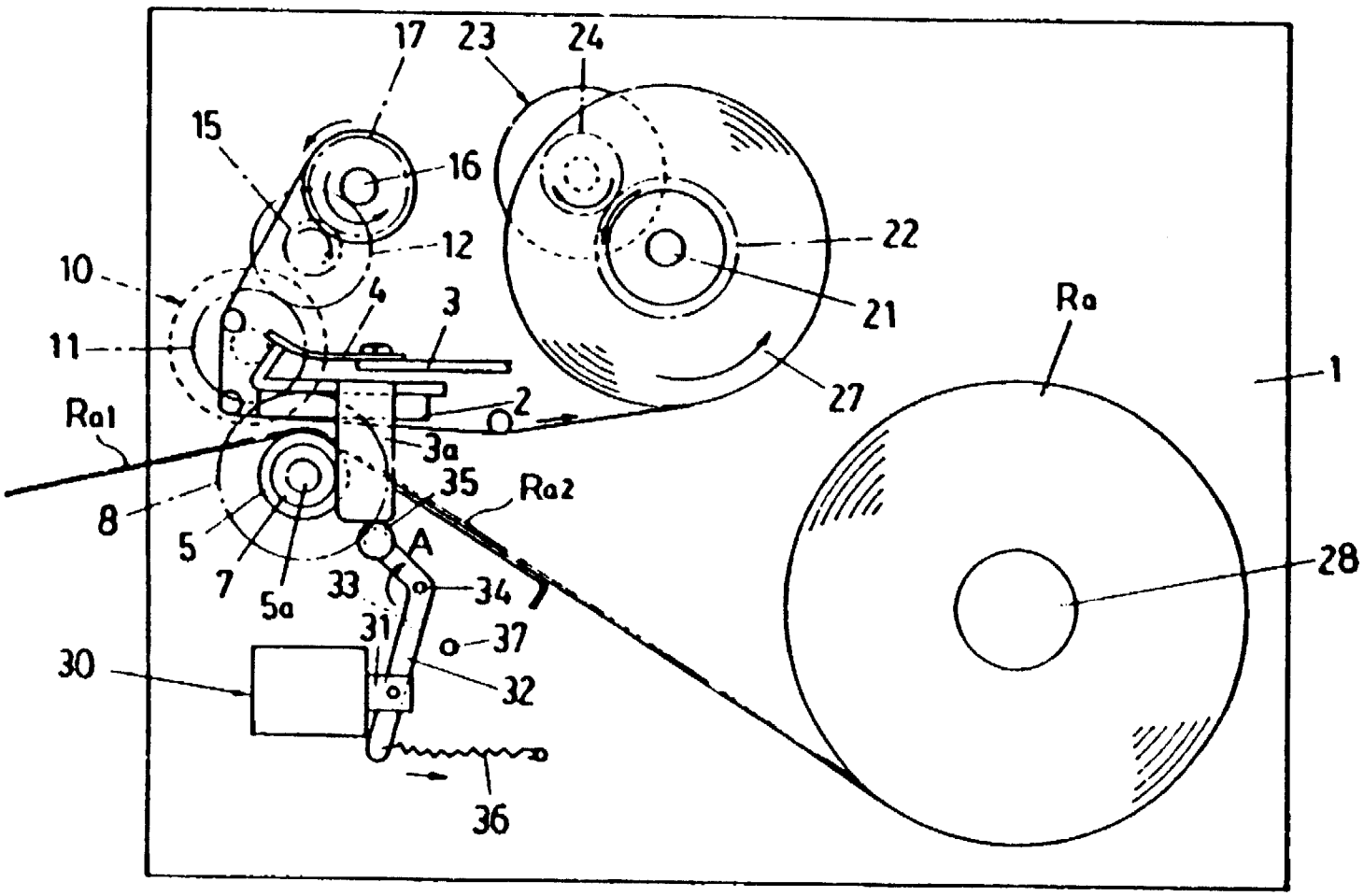
FIG. 5 is a schematic view of the printer in FIG. 1 wherein a DC solenoid 30 is actuated from the state in FIG. 4 to separate a thermal head 2 from a platen 5.

Then the DC solenoid 30 is energized to draw the plunger 31 toward left in FIG. 5, thereby to turn the arm 32 which is rotatably connected to the plunger 31 by way of a pin and the arm 33 united with the arm 32 in the direction of the arrow A about the shaft 34.

As a result, the bosses 35 and 35 fixed to the sides of the upper ends of the arms 32 and 33 are lifted to be brought into contact with the lower ends of leg portions 3*a* and 3*a* of the head holding plate 3 and lifts the same so as to separate the thermal head 2 from the platen 5.

When the motor 23 for winding back the ribbon is rotated in the direction of the arrow in FIG. 5 keeping this state, the ribbon 27 is wound back as illustrated by an arrow in the figure.

At that time, the gear 22 for rotating the ribbon supply spool 21, the gear 24 which engages with the gear 22 and the ribbon take-up spool 16 and the disc 19 on the ribbon take-up side rotate in the direction of taking up the ribbon 27.

The motor 10 may be kept not to rotate in the holding state during rewinding the ribbon 27.

The amount of rewinding the ribbon 27 at that time can be determined by way of various methods employing dip switches (referred to as dip SW hereinafter), a rotary switch (referred to as a rotary SW hereinafter), keys, etc. depending on the printing condition.

This embodiment exemplifies a case wherein a rotary SW is employed.

The printer can perform a test printing before a regular printing for previously determining how many times the ribbon can be used before the printed state is not more acceptable.

A main control portion 40 which functions as a test printing means for setting the transfer medium reverse direction conveying ratio, described later with reference to FIG. 9, controls each unit for performing the test printing.

In case of performing the test printing, the rotary SW is set at 10 to print 10 labels for testing.

In this case, printing is performed on the first label Ra1 using the ribbon 27 which is an unused state, and upon completion of the first test printing, the thermal head 2 is separated from the platen 5 and the ribbon is wound back as far as 90% of the length thereof which has been used for printing on the first label Ra1 as described with reference to FIG. 5 so as to be ready for printing on the second label Ra2.

Similarly with the third and later labels, upon completion of the preceding test printing, the thermal head 2 is separated from the platen 5 and the ribbon is wound back for printing on the succeeding label as far as 90% of the length thereof which has been used for printing on the preceding label.

Figure 6:
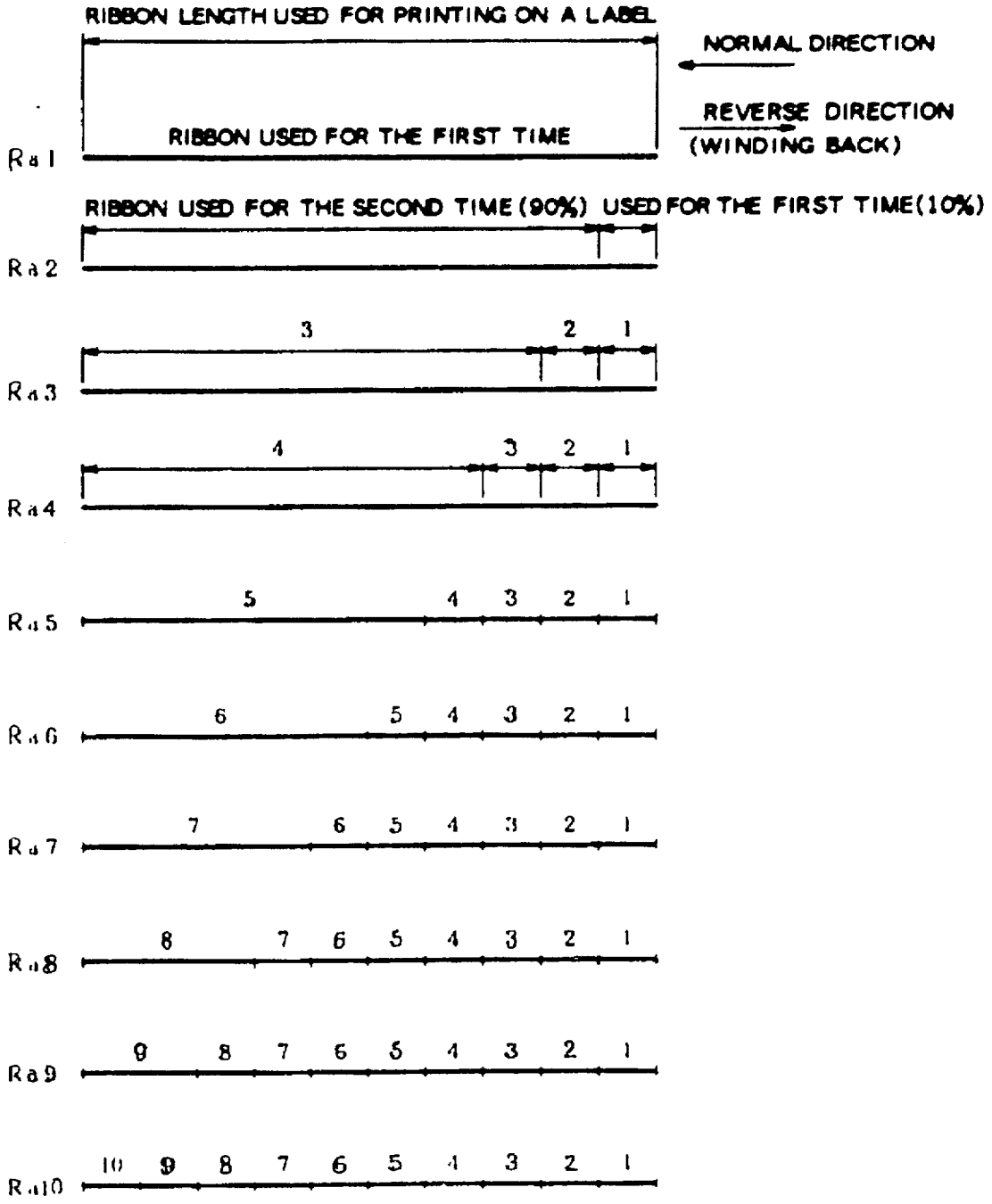
FIG. 6 is a view showing labels Ra1 to Ra10 and the frequencies of using a ribbon when a test printing has been performed on the labels by the printer in FIG. 1.

FIG. 6 shows the relation between the labels Ra1 to Ra10 printed in this way and the frequencies of repeated use of the ribbon for them.

Printing on the first label Ra1 uses the ribbon for the first time at an unused state, so that printed letters are naturally clear. Printing on the second label Ra2 uses 90% of the ribbon for the second time and 10% thereof for the first time.

Printing on the third label Ra3 user 80% of the ribbon which has been used for the first and second printings for the third time, 10% thereof for the second time and 10% thereof for the first time, and printing is performed successively in this way.

In FIG. 6, as to the label Ra3 and the later labels, the second use is denoted at "2", the third use at "3" and in the same way the succeeding times of use are simply denoted at the numerals alone indicating the frequencies of use.

Although the amount to wind back the ribbon is set to be 90% of the length of the ribbon used for preceding printing in the example set forth above, it is also possible to be set at other percentages.

In case of printing in this way, it is a matter of course that a printing quality, i.e., a printing density etc. is gradually reduced as the number of printed labels increases.

Upon completion of the test printing on 10 labels, the printed states thereof are investigated by the user's eyes to determine how far they can be used and a rotary SW is set at the number which is equal to the number of usable labels among the 10 test printed labels for the following regular printing operation.

That is, supposing that the user decides that 5 labels are allowable in their printed state among the 10 labels subjected to the test printing, he sets the rotary SW at 5 and starts printing operation.

Figure 7:
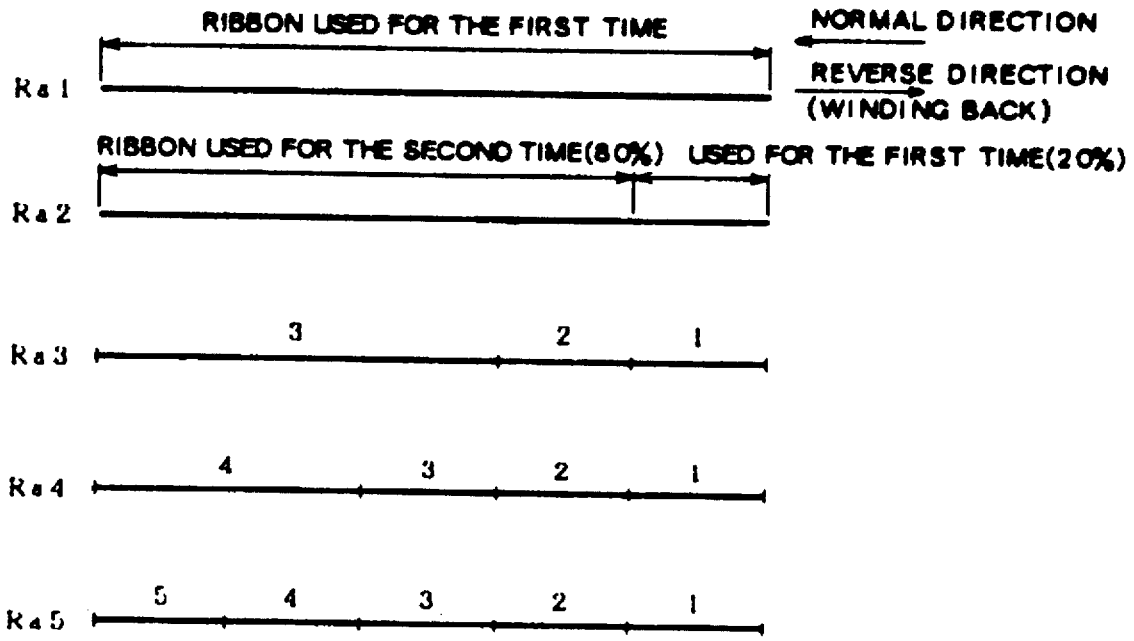
FIG. 7 is a view showing the frequencies of using the ribbon in each portion of the labels supposing that the ribbon is repeatedly used so far as five times.

Since the frequency of the repeated use of the ribbon in printing is 5 in that case, the amount of winding back the ribbon upon completion of printing may be 80% as illustrated in FIG. 7, so that 80% of the whole length of the ribbon used for printing on the first label Ra1 is wound back for printing on the second label Ra2 after printing is performed on the first label Ra1 using the ribbon in an unused state for the first time.

As a result, printing on the second label Ra2 is performed with the used portion of the ribbon and an unused portion appended thereto by 20%. Printing on the third Ra3 and later labels is similarly performed by always appending an unused portion to the used ribbon by 20%.

The frequency of the repeated use of the ribbon is denoted at numeral alone as to the third and later labels in FIG. 7.

Since the ratio of winding back amount of the ribbon upon completion of each printing is 80% in case printing starts with the rotary SW set at 5, the ribbon winding back coefficient becomes 0.8 according to the following formula (1)

$$K=1-(1/\textit{the number of the rotary SW}) \quad (1)$$

Since the number of pulses which can be used for representing the amount of use of the ribbon used for printing on the first label Ra1 is n1, the motor 23 for winding back the ribbon is rotated in the direction of the arrow in FIG. 5 corresponding to the number of pulses "n1×0.8".

When the DC solenoid 30 is deenergized (OFF) after the given length of the ribbon is wound back, the arms 32 and 33 turn in the direction reverse to the arrow A by the resilience of the coil spring 36 and the plunger 31 moves to the right in FIG. 5.

As a result, the thermal head 2 which has been pushed up by the bosses 35 and 35 by way of the head holding plate 3 lowers to press on the platen 5 again so as to enable next printing as it is released from a head-up state.

Figure 8:
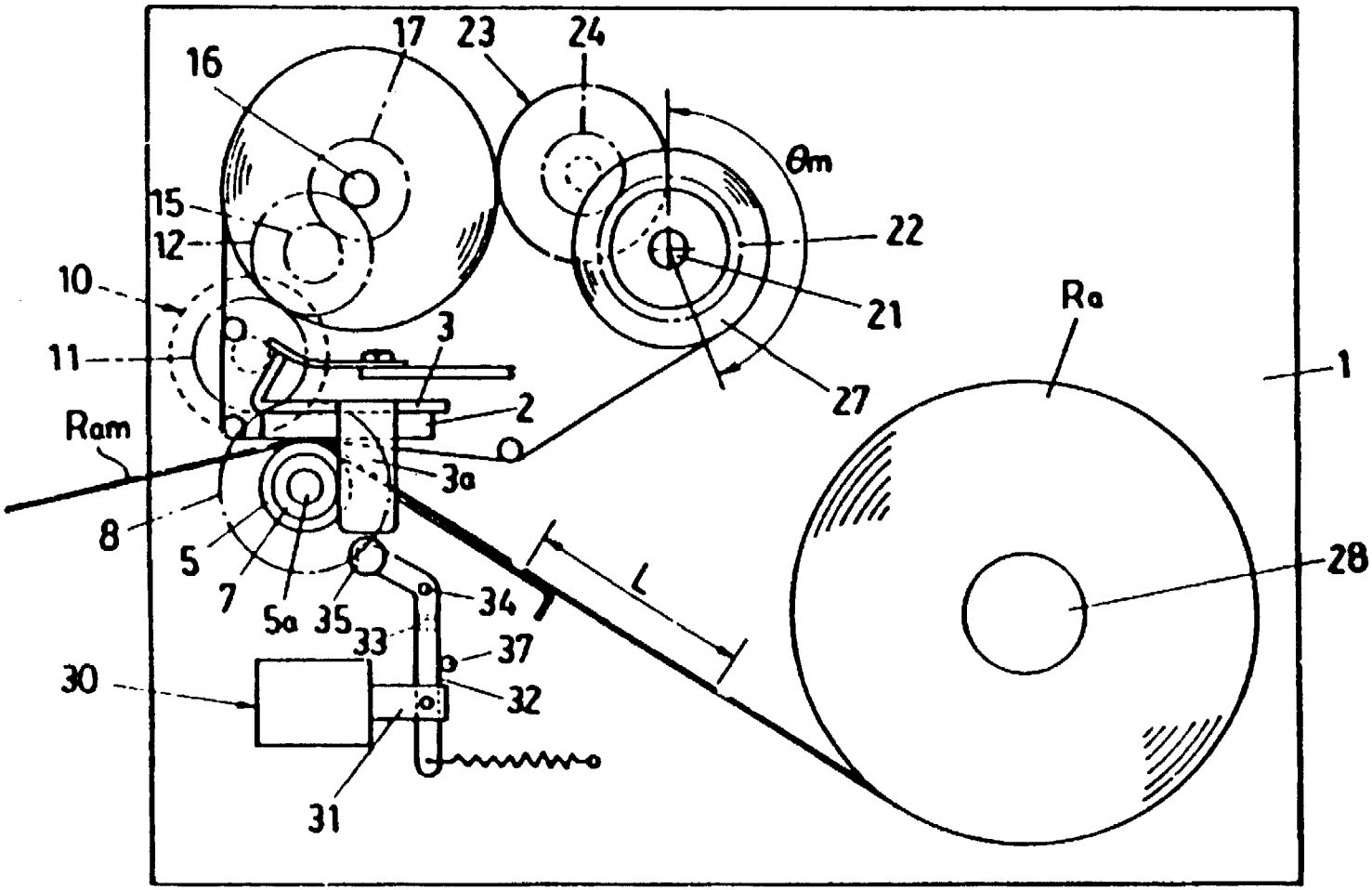
FIG. 8 is a schematic view of the printer in FIG. 1 wherein printing on the mth label Ram has been completed.

When printing on the mth label Ram is completed after repeating the above operation as illustrated in FIG. 8, the diameter of the ribbon wound around the ribbon supply spool 21 is small on the supply side and that wound around the ribbon take-up spool 16 is large on the take-up side as a matter of course.

Supposing that the conveying length of a label Ra is L, the length of the ribbon 27 consumed for printing thereon is also L, to which corresponds the angle θ1 in FIG. 4, and the angle θ1 is represented by the number of pulses n1 as described above.

The length of the ribbon 27 used for printing on the mth label Ram in FIG. 8 is also L, to which corresponds the angle θm in the same figure, and the angle θm is represented by the number of pulses nm, the angle θm is larger than the angle θ1 in FIG. 4 since the diameter of the ribbon roll has become smaller.

The numbers of pulses n1 and nm naturally represent the same length L of the ribbon 27 although they are different in number from each other since they are different from each other in the diameter of the ribbon 27 wound around the ribbon supply spool 21, i.e., the radius of revolution of the ribbon 27.

Accordingly, it is possible to wind back the ribbon 27 always by a given length irrespective of the variation of the number of pulses which depends on the diameter of the ribbon 27 on the supply side by re-counting the number of pulses per label (a given length) and being based on the re-counted number of pulses.

When the rotary SW is set at 1, the ribbon winding back coefficient K=0 (refer to formula (1)) is established so that the ribbon 27 is not wound back and a series of operations in this embodiment do not make sense. In this case the printer operates as a normal printer without the operation set forth above.

Also in case the amount of the ribbon 27 to be wound back is set to range from 1% to 100% by way of a means other than the rotary SW set forth above, e.g. keys, it is recommendable that the printer is designed to perform normal printing without winding back the ribbon 27 as set forth above when an impractical amount of the ribbon 27 to be wound back, e.g., 1% or 2% is inputted.

Although a case wherein the ribbon 27 is wound back every time printing is completed on a label is described above, it is more efficient to wind back the ribbon 27 every time printing is performed on labels bundled to some extent such as 10 or 20 labels instead of only a label in case of a recording medium such as a label which is short in the conveying direction, so that the printer is designed to perform printing also under such conditions.

That is, it is possible to control the printer quite similarly by counting the number of pulses which corresponds to the conveying amount of the ribbon 27 for a unit of labels.

As described above, the printer according to this embodiment can always maintain the quality of print above a given level by performing a test printing before the start of regular printing (recording) operation to thereby confirm the quality of print such as density or blur and set the frequency of repeated use (multi-pass) of the ribbon allowable for the purpose and repeatedly using the ribbon 27 within the set frequency of use.

Since printing is continued by winding back the used ribbon 27 by the set given amount every time a unit of printing is performed on a sheet or sheets of paper bundled to some extent, there is no need to reset the ribbon which has been all rolled up round the ribbon take-up spool onto the ribbon supply spool again as in conventional printers which do not wind back the ribbon after printing, so that it is laborsaving.

Also the conventional printers require a troublesome work of recording the frequency of use of the ribbon when the once used ribbon is reset onto the supply side, this embodiment can save an operator the troublesome work.

Moreover, in case a comparatively less frequently used ribbon is broken halfway, the conventional printers require a troublesome management of one of the pieces of the broken still usable ribbon to be kept for later use.

According to the embodiment, however, since the side of the ribbon which has passed the thermal head 2 has been already used up, it may be thrown away, which eliminates all the troublesome management.

Furthermore, when, for example, a ribbon 27 having a whole length of 400 m is once set on the ribbon supply spool 21 in case of printing with 80% winding back the ribbon as described in FIG. 7, it is possible to print on a recording medium of 2000 m long such as labels corresponding to 5 times as long as the whole length of the ribbon, so that it is suitable for printing on a large capacity recording medium by automation.

Even with a ratio of winding back amount of the ribbon other than that described above, it is possible to use the ribbon as if it were several times as long as itself.

Figure 9:
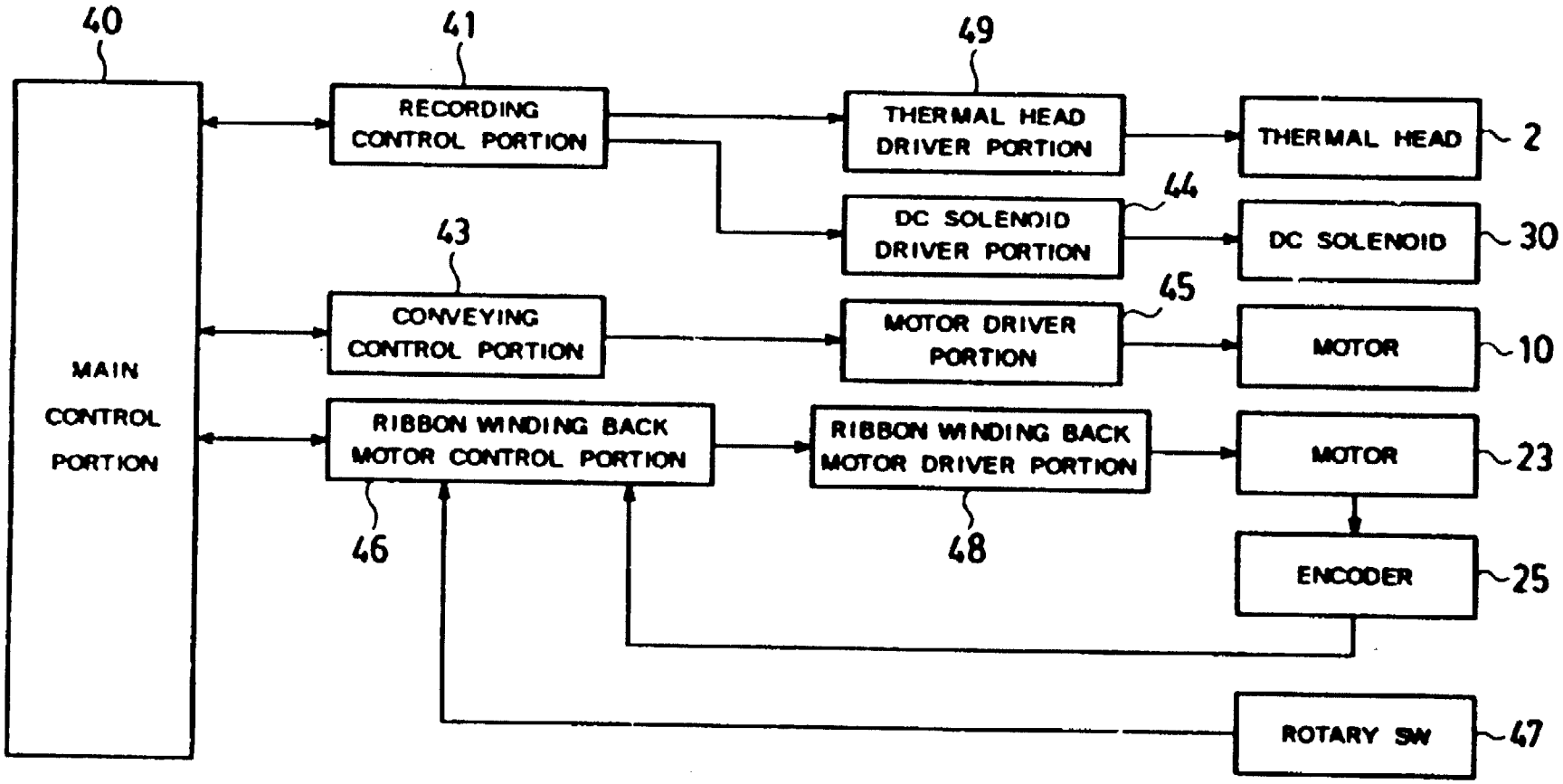
FIG. 9 is a block diagram of a part which relates to the present invention in the control system of the printer.

FIG. 9 is a block diagram of a part which relates to this invention in the control system of the printer.

A main control portion 40 exchanges signals with a recording control portion 41, which supplies a signal for printing to a thermal head driver portion 49 based on a recording information supplied by the main control portion 40 so as to control the thermal head 2 which serves as a recording means.

The recording control portion 41 supplies a signal for driving the DC solenoid 30 for separating the thermal head 2 from the platen 5 to a DC solenoid driver portion 44.

A conveying control portion 43 supplies a signal for driving the motor 10 which constitutes the transfer medium conveying means to a motor driver portion 45 at a given interval so as to convey the ribbon 27 in the normal direction toward the thermal head 2 by rotating the motor 10 in printing.

A ribbon winding back motor control portion 46 which functions as a transfer medium reversely conveying amount control means receives the number of pulses from the encoder 25 which is a transfer medium normal direction conveying amount measuring means for detecting the rotating amount of the rotating shaft 23*a* (refer to FIG. 3) of the motor 23 for winding back the ribbon constituting the transfer medium conveying means.

Moreover, a rotary SW 47 serving as the transfer medium reverse direction conveying ratio setting means also supplies a signal corresponding to the frequency of repeated use of the ribbon which the user has decided to the ribbon winding back motor control portion 46 according to this embodiment.

Then the ribbon winding back motor control portion 46 supplies a signal for winding back the ribbon to a motor drive portion 48 to drive the motor 23 for winding back the ribbon 27 by a given amount.

Figure 10:
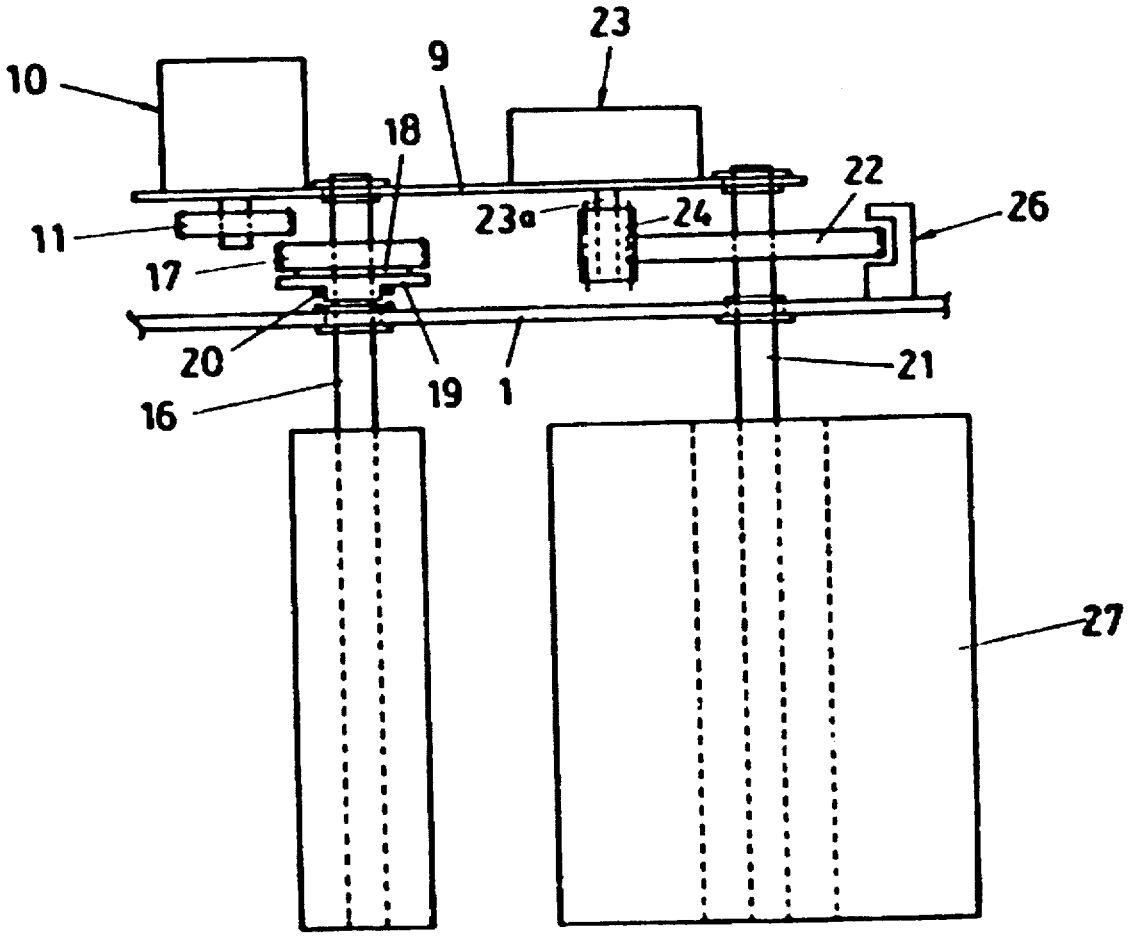
FIG. 10 is a plan view showing a printer having a different arrangement being provided with a transfer medium normal direction conveying amount measuring means according to a modified first embodiment of the invention.

Modified First embodiment (FIG. 10)

FIG. 10 is a plan view of a printer equipped with a transfer medium normal direction conveying amount measuring means having a different arrangement similar to the plan view of the printer according to the first embodiment in FIG. 3 and components corresponding to those in FIG. 3 are denoted at the same numerals.

The printer differs from that of the first embodiment in FIG. 3 only in that the transfer medium normal direction conveying amount measuring means thereof employs a photosensor 26 provided at a position for detecting the threads of the gear 22 fixed to the ribbon supply shaft 21 instead of the encoder 25 equipped with the slit disc 25*a* fixed to the rotating shaft 23*a* of the motor 33 mechanically interlocked in rotation with the ribbon supply shaft 21 to which the ribbon 27 serving as the transfer medium is attached thereby to count the number of threads of the gear 22 for producing the number of pulses corresponding to the amount of use of the ribbon 27.

The second embodiment having such an arrangement can also obtain an effect similar to the first embodiment in FIG. 3.

Although the transfer medium normal direction conveying amount measuring means is arranged on the side of the ribbon supply shaft 21 to which the ribbon 27 serving as the transfer medium is attached for measuring the rotating amount thereof in each embodiment set forth above, it may be also arranged on the side of the ribbon take-up shaft 16 for taking up the ribbon 27 or a member interlocked with the same instead of on the side of the ribbon supply shaft 21.

Second Embodiment (FIGS. 11 to 19)

A printer equipped with a verifying unit 50 for verifying the content recorded in the recording medium such as a bar code etc. and a void stamper 70 for forming an invalid index on the recording medium when the recorded content is defective according to a second embodiment will be described hereinafter with reference to FIGS. 11 to 19.

The printer according to the second embodiment differs from that of the first embodiment in FIG. 1 in comprising the verifying unit 50 serving as a verifying means and the void stamper 70 serving as an invalid index forming means.

The verifying unit 50 is arranged downstream the thermal head 2 and platen 5 in the conveying direction for verifying whether there is a defect or not in the content of the symbols such as bar codes etc. recorded on the labels Ra by the thermal head 2.

The void stamper 70 is arranged downstream the verifying unit 50 for forming an invalid index (invalid mark) on a label Ra when the verifying unit 50 detects a defect in the recorded content of the label Ra.

That is, in case the content recorded by the thermal head 2 contains the bar codes etc., the bar codes etc. are verified whether they are correctly recorded or not so that they may be read and deciphered later by a reader such as a bar code reader etc. employing an electro-optical technology.

The verifying is made for preventing the publication of the defective labels since the thermal head 2 is an article of consumption and the multi-pass thermal transfer ribbon 27 serving as a transfer medium is repeatedly used at the same portions thereof for double printing so that symbols such as a bar code etc. recorded thereby are liable to cause defective labels which are unreachable later by a bar code reader for reading the same by way of the electro-optical technology.

Figure 12:
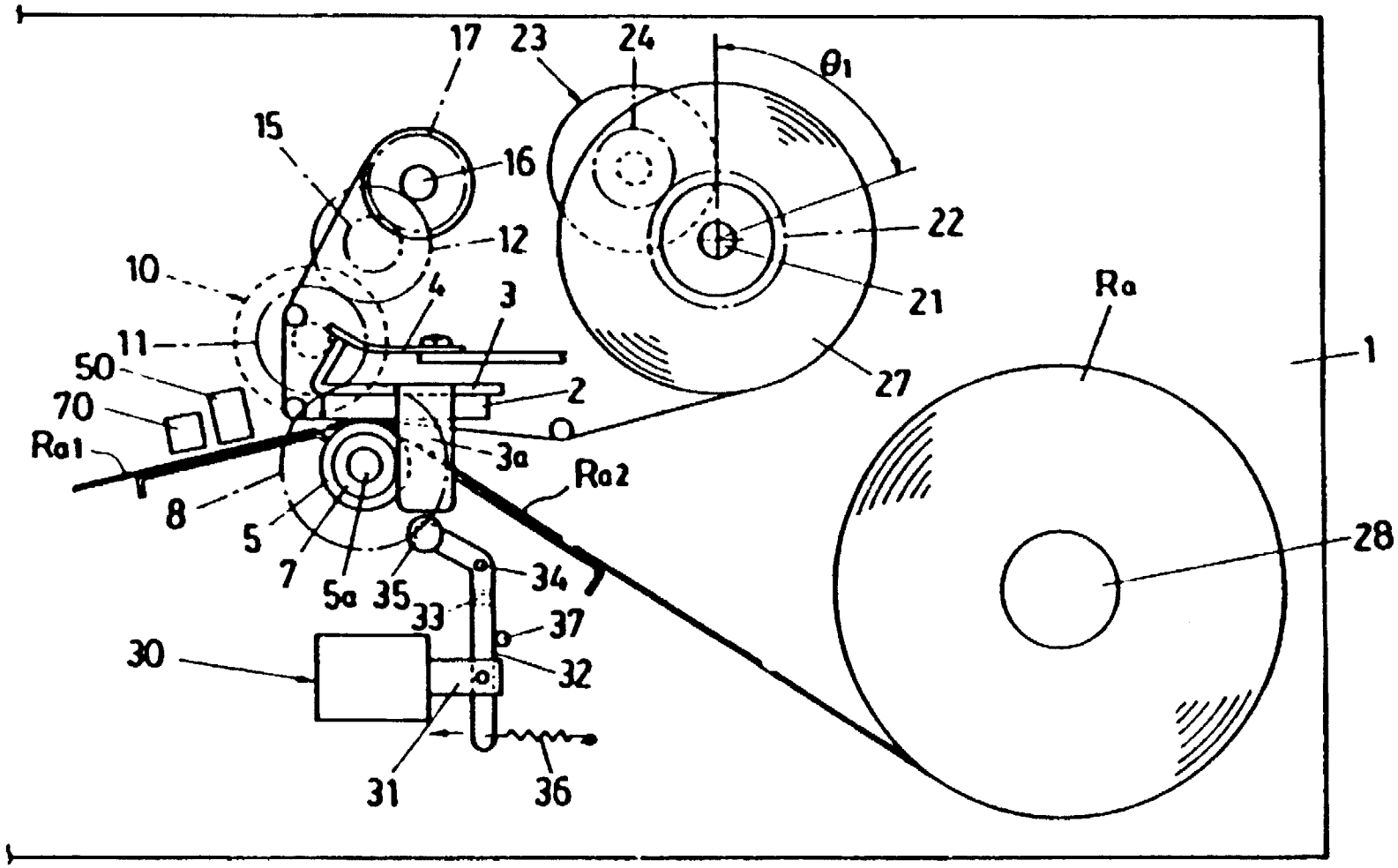
FIG. 12 is a schematic view of the printer in FIG. 11 wherein the first label Ra1 has been printed.
Figure 13:
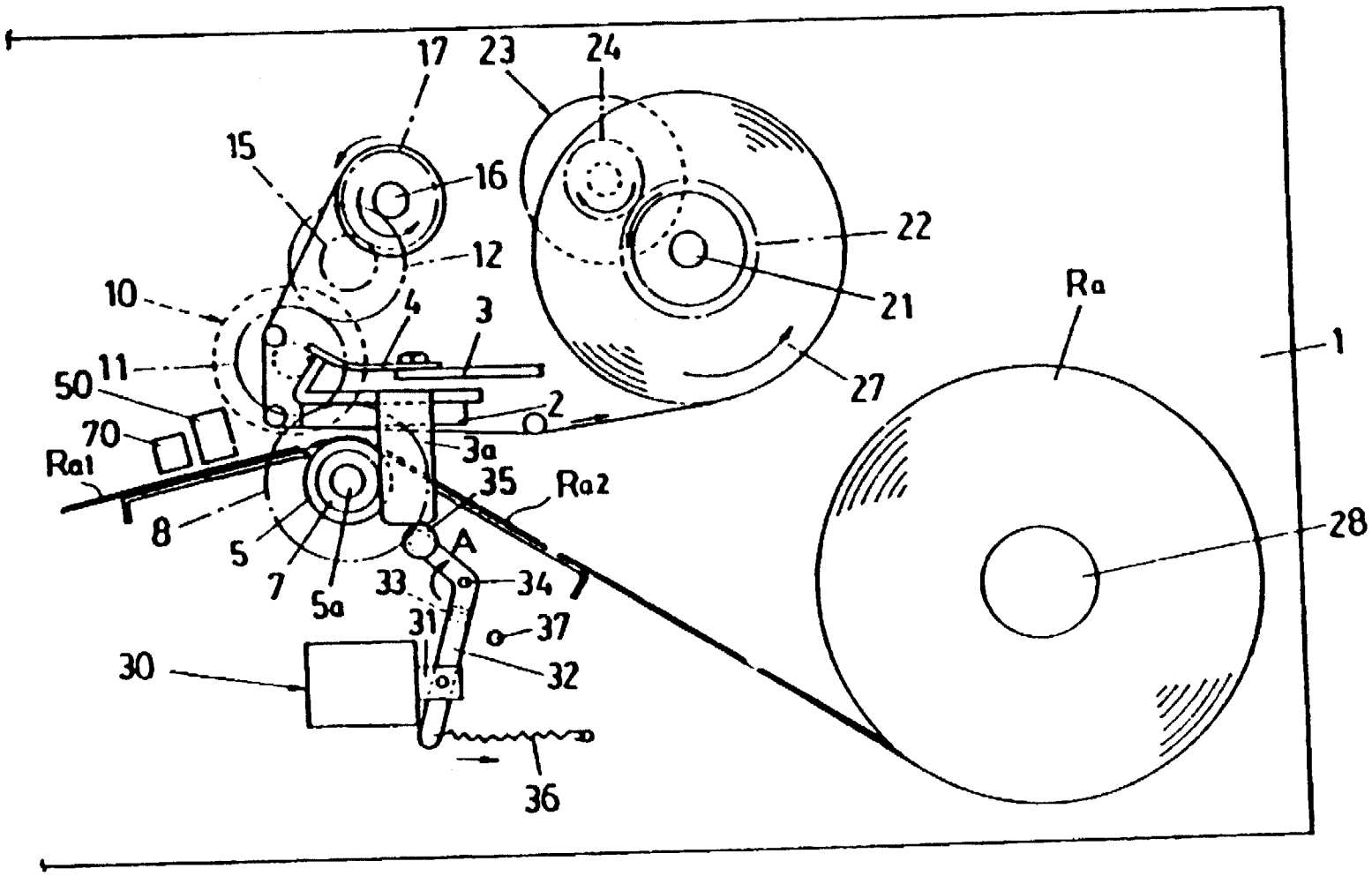
FIG. 13 is a schematic view of the printer in FIG. 12 wherein a DC solenoid 30 is actuated from the state in FIG. 12 to separate a thermal head 2 form a platen 5.

Also in this embodiment, the DC solenoid 30 is energized to turn the arm 32 about the shaft 34 in the direction of the arrow A as illustrated in FIG. 13 upon completion of printing on the first label Ra1 as illustrated in FIG. 12, so that the bosses 35 and 35 lift the head holding plate 3 to separate the thermal head 2 from the platen 5.

At this state, the motor 23 for winding back the ribbon turns clockwise in FIG. 13 so as to wind back the ribbon 27 by a previously set given amount for next printing in the same way as in the embodiments described above with reference to FIGS. 1 to 10.

Figure 14:
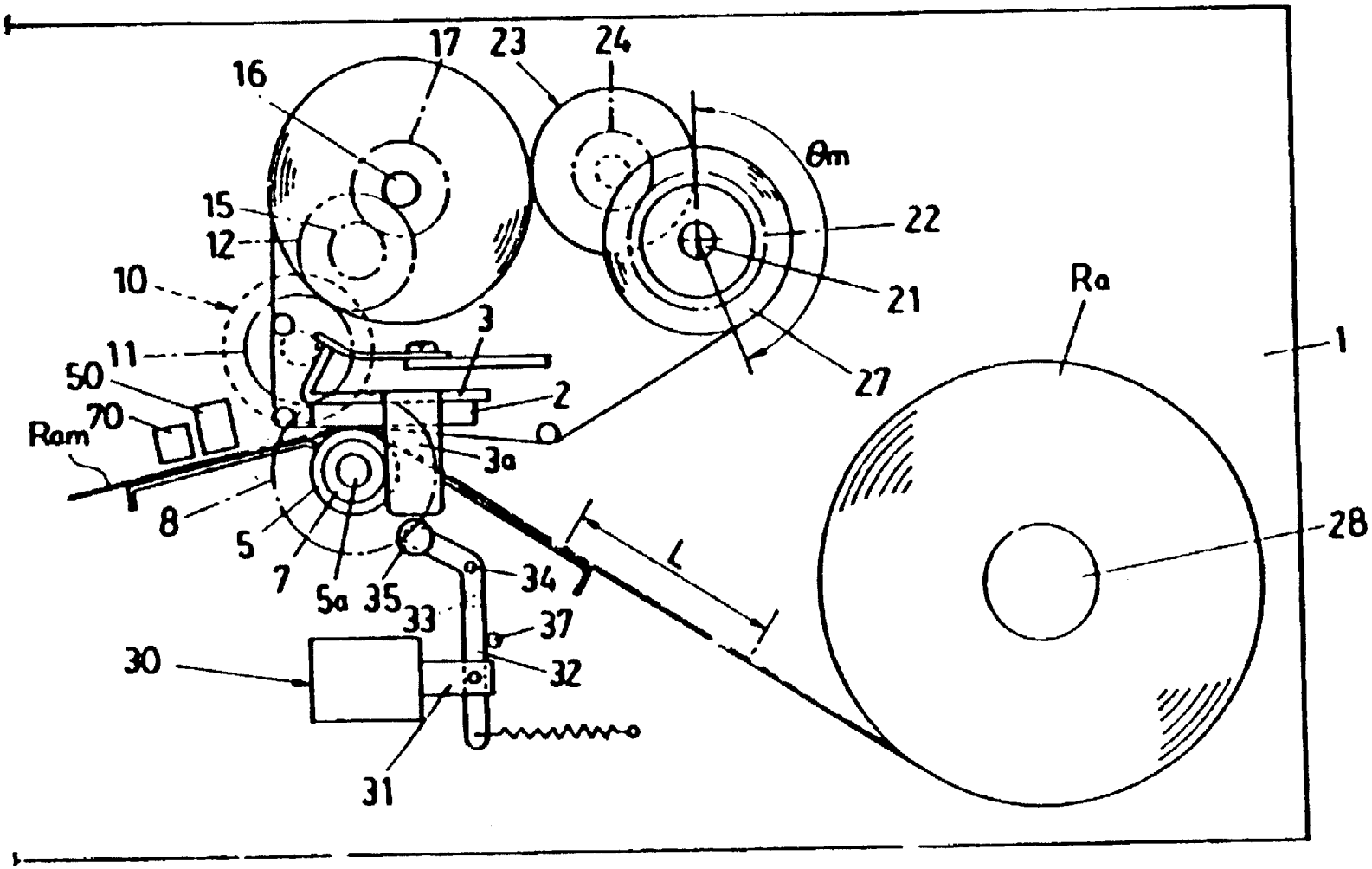
FIG. 14 is a schematic view of the printer in FIG. 11 wherein printing on the mth label Ram has been completed.

FIG. 14 shows the printer in a state where printing on the mth label Ram is completed.

Figure 15:
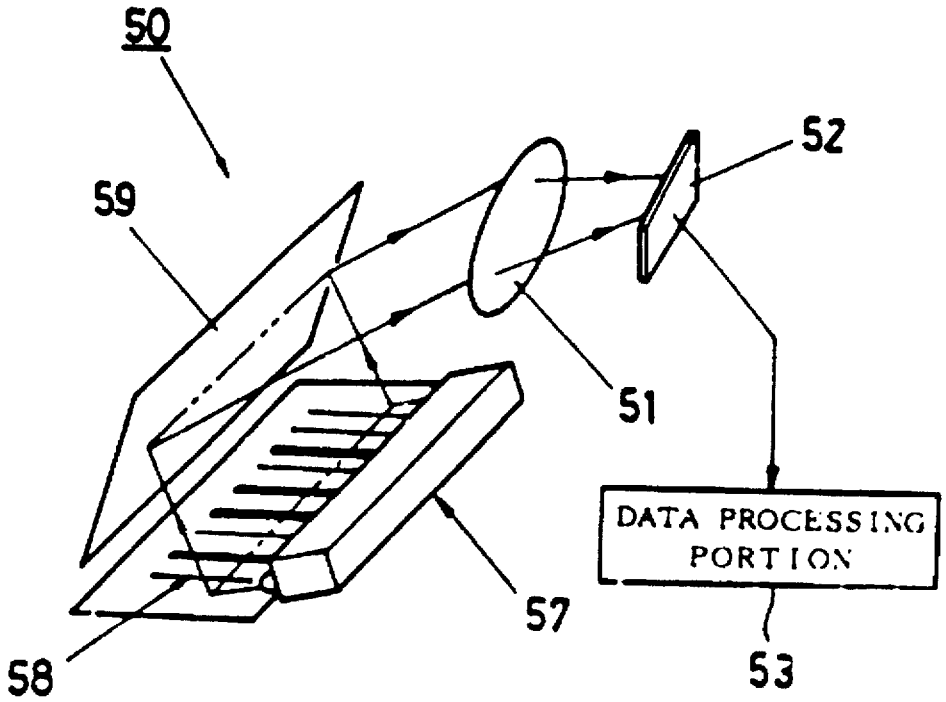
FIG. 15 is a perspective view showing an example of a verifying unit provided in the printer in FIG. 11.

In the verifying unit 50 of the printer as illustrated in FIG. 15, for example, a recording portion such as a bar code 58 irradiated by an LED array 57 reflects light, which is further reflected by a reflector 59 to reach a CCD line image sensor 52 (referred to simply as a CCD52 hereinafter) having been converged by a lens 51 and the CCD52 converts the received light into electricity as a photoelectric transducer so as to supply each analog signal corresponding to each pixel to a data processing portion 53.

The data processing portion 53 digitizes the inputted information and supplies the same to a bar code verifying control portion 42 (FIG. 18), described later.

The bar code verifying control portion 42 decodes the digitized signal and compares the same with the inputted data to be recorded so as to decide whether the inputted data has a normally recorded content which is readable and flawless or not.

If the result is normal, the label Ra is discharged as it is since the bar code 58 can be read later by a bar code reader.

If the result is abnormal and a defect is detected, the label Ra is discharged after an invalid index is stamped thereon by activating the void stamper 70.

In this way the flawless recorded contents capable of being read later by a bar code reader are discriminated from the defective recorded contents which is unreadable or liable to be wrongly read so as to specify the defective labels etc.

Figure 16:
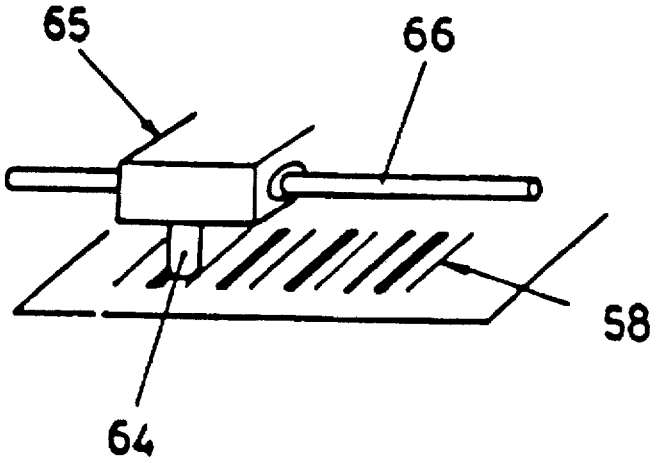
FIG. 16 is a perspective view showing another example of the verifying unit.

The verifying unit 50 also may comprise a pen-type scanner 64 mounted on a carriage 65 which travels along a guide shaft 66 by a driving motor, not shown, for reading the bar code 58 as illustrated in FIG. 16.

Figure 17:
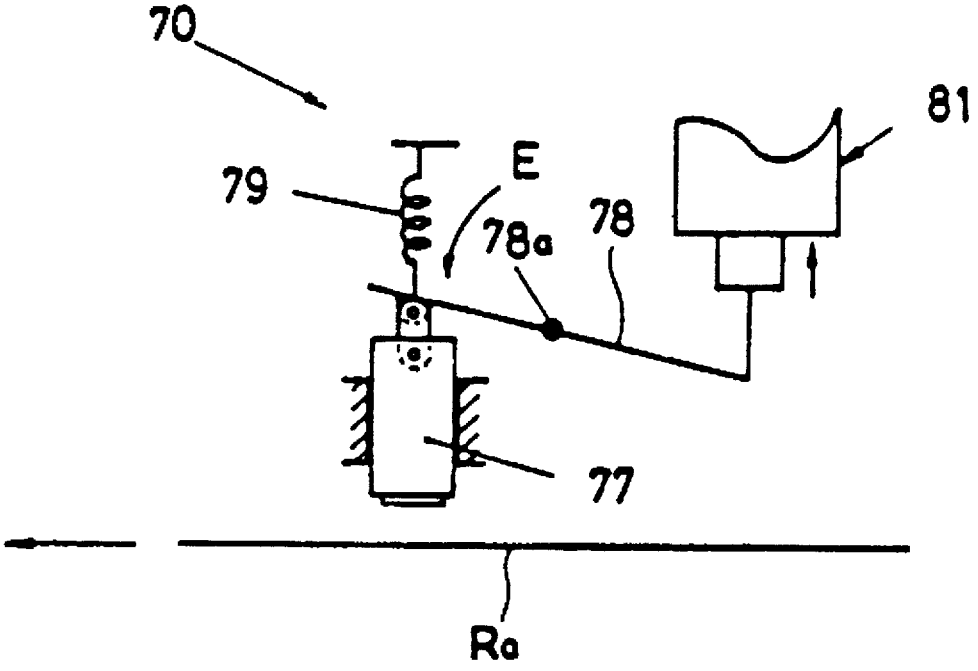
FIG. 17 is a schematic view exemplifying a void stamper provided in the printer in FIG. 11.

The void stamper 70 comprises a stamper 77 to which ink is automatically supplied and which is supported in such a way as to be vertically movable toward or away from the label Ra and is rotably attached to one end of a swinging member 78 at the upper end thereof as exemplified in FIG. 17.

The swinging member 78 is swingable about a substantially central portion 78*a* thereof and forces the stamper 77 to move away from the label Ra in a normal state by a spring 79 mounted between one end thereof on the side of the stamper 77 and a stationary portion of the printer.

A solenoid 81 attached to the other end of the swinging member 78 is activated (ON) to swing the swinging member 78 in the direction of the arrow E so as to lower the stamper 77 for stamping the upper surface of the label Ra.

Although the void stamper 70 is described above as an example of an invalid index forming means, it is also possible to print a clearly recognizable pattern or mark on the bar code by the thermal head 2 after conveying the label Ra backward in case the verifying unit 50 detects abnormality therein instead of providing the void stamper 70.

Figure 18:
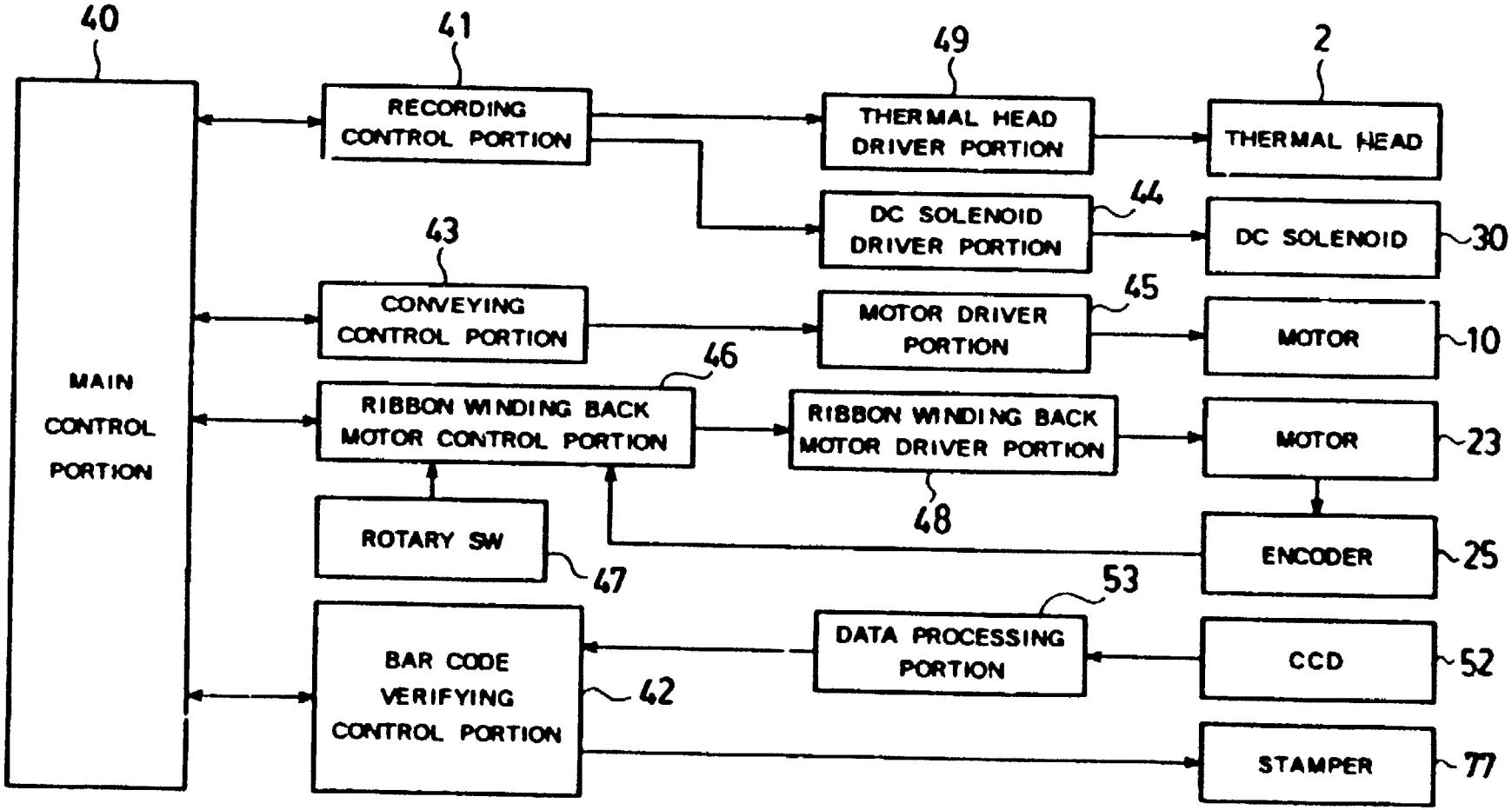
FIG. 18 is a block diagram of the control system of the printer in FIG. 11.

FIG. 18 is a block diagram of the control system of the printer described with reference to FIGS. 11 to 17, wherein the components corresponding to those in FIG. 9 are denoted at the same numerals and the explanation thereof is omitted.

The bar code verifying control portion 42 receives an image signal produced by the CCD52 of the verifying unit 50 and binary-coded by the data processing portion 53 to verify whether it has a flawless recorded content or not based on the information supplied by the main control portion 40 and operates the stamper 77 by way of the DC solenoid driver portion, not shown, to stamp on invalid index such as an invalid mark etc. on the label Ra in case the received signal is defective.

The bar code verifying control portion 42 also functions as a reverifying means for verifying the same recorded content again changing the scanning path in case a defect is detected by the above verifying.

In the printer according to this embodiment, the reverse direction conveying amount of the ribbon 27 serving as a transfer medium is properly set by way of the rotary SW 47, the ribbon 27 is wound back to the direction reverse to the normal direction toward the thermal head 2 by a given amount according to the reversely conveying amount information managed by the ribbon winding back motor control portion 46 which is a transfer medium reversely conveying amount information management means every time printing on a unit of recording medium such as a label or several labels by the thermal head 2 is completed and is conveyed again in the normal direction for printing.

In case the recorded content printed by the thermal head 2 contains a symbol such as a bar code etc., the recorded content is verified by the verifying unit 5 and the void stamper 70 stamps an invalid index on the label having the recorded content in which a defect is detected in case the verifying unit 50 detect the detects.

The reason why the ribbon is wound back to the reverse direction by a given amount according to the reversely conveying amount information managed by the ribbon winding back motor control portion 46 every time printing on a unit of recording medium such as several labels other than a label is that in case of a recording medium such as a label which is short in the conveying direction it is more efficient winding back the ribbon after printing or every unit of labels bundled to some extent such as 10 or 20 labels than after printing on every label.

The verifying process of the recorded content performed by the printer will be described hereinafter with reference to a flowchart in FIG. 19.

When processing starts a routine relating to the verifying process of the recorded content, it is decided whether a defect is detected or not based on the verifying result of the content recorded on the label in Step 1. If no defect is detected, it advances t next recording process in Step 2 and thereafter returns to a main routine, but if a defect is detected, it advances to Step 3 without printing an invalid index.

Whereupon it performs re-verifying (re-scanning) by way of a scanning path which is different from that employed in Step 1 to decide whether the defect is detected in the recorded content again or not.

The change of the scanning path can be performed by conveying the label a bit in the normal or reverse direction by the motor 10 (FIG. 1) after the first verifying of Step 1 in case the verifying is performed in the state wherein the recording medium conveying operation is stopped.

In case the verifying is performed in a state wherein the recording medium conveying operation is not stopped, the scanning path can be changed in the second verifying by stopping the recording medium conveying operation to perform the re-verifying of Step 3 when the first verifying detects the defect.

If no defect is detected in Step 3, the processing advances to Step 2 to perform next recording process, but if a defect is detected, it advances to Step 4 to print an invalid index on the label in which the defect is detected by the void stamper 70 (FIG. 17) and thereafter advances to Step 5.

A recorded content (symbol) which is the same as that in which the defect is detected in Step 3 is re-recorded in the recording portion of next label in Step 5 and the re-recorded content is verified to decide whether the defect is detected or not therein in Step 6.

If no defect is detected, the processing advances to Step 2 to perform next recording process, but if a defect is detected it advances to Step 7 to print an invalid index on the label which is re-recorded and the defect is detected therein and thereafter it advances to Step 8.

Figure 11:
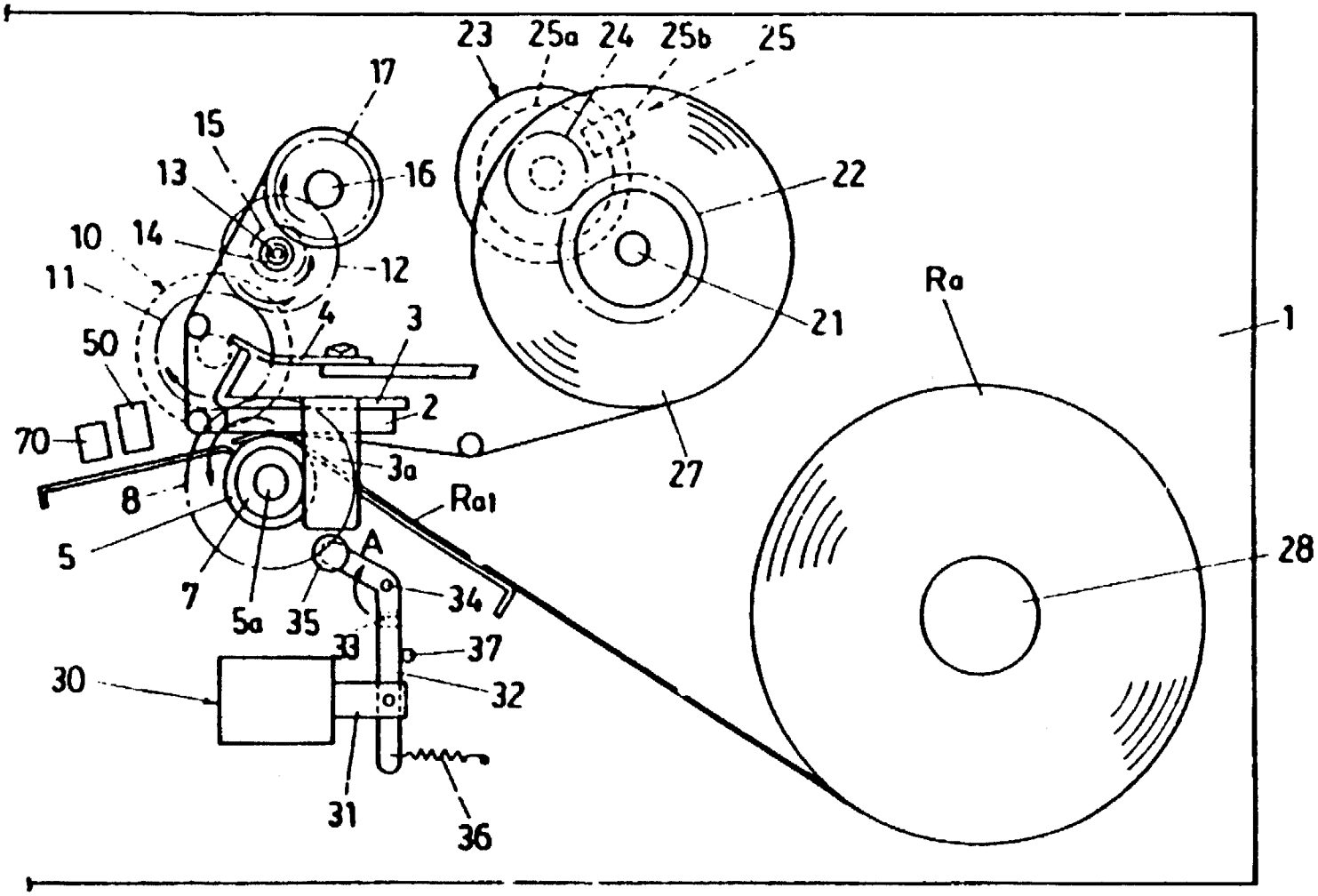
FIG. 11 is a view showing the whole arrangement of the printer provided with a verifying unit 50 for verifying the recorded content of a bar code etc. recorded on a recording medium and a void stamper 70 for forming an invalid index thereon when the recorded content is defective according to a second embodiment of the invention.

The winding back the ribbon 27 (reverse direction conveying) by the reverse direction conveying amount set by the rotary SW 47 (in FIG. 18) in normal recording operation is stopped and the ribbon 27 is conveyed only in the normal direction, i.e. toward the left in FIG. 11 and a recorded content which is the same as that in which the defect is detected in Step 6 is recorded again in the recording portion of next label using the unused portion of the ribbon 27 in Step 8.

The content recorded by using the unused portion of the ribbon 27 is verified whether it is defective or not in Step 9, and if it is, the processing advances to Step 10 to print an invalid index thereon.

In this case an operator call is displayed for giving an alarm for a disorder and the operation of the whole printer is stopped recognizing the generation of some trouble such as constant wrinkles in the ribbon 27 and the like in Step 11.

If no defect is detected in Step 9, it proves that the ribbon winding back amount (reverse direction conveying amount) set by the rotary SW 47 is improper and the ribbon has been reversely conveyed too much in printing in Step 5.

Accordingly, the printing advances to Step 12 to reduce the ribbon winding back amount and print on a given number of labels which is necessary for uniformly printing a given length of record under this condition and thereafter advances to next Step 13 to verify the recorded content therein.

That is, supposing that the rotary SW 47 sets the ratio of winding back amount of the ribbon to the given length thereof which is used for printing to 90%, the winding back amount is reduced to 80% and printing is performed on 5 labels on which the given length is uniformly printed with the ribbon winding back amount of 80% (FIG. 7) (printing is performed on 10 labels with the ribbon winding back amount of 90%) and thereafter the recorded content is verified.

A case in which the ribbon is wound back so much that a defect is detected in the printed content in the decision in Step 9 is, for example, a case in which the bar code is long in the conveying direction and the ribbon winding back amount is too much so that double printing is often performed by repeatedly using the ribbon in the portion of the bar code where a bar exists.

In Step 13, it is decided whether a defect is detected or not in the content recorded in Step 12 and if no defect is detected the processing advances to Step 2 and the later recording processes are performed with the ribbon winding back amount set in Step 12.

Also in Step 13, in case, for example, the bar code also exists in the portion of the label Ra5 denoted at 5 (which indicates that the ribbon is used for the fifth recording) as illustrated in FIG. 7 and a defect only in the portion of the bar code which is printed by the portion of the ribbon used for the fifth time is detected while no defect has been detected until the Ra4 which is printed by the portion of the ribbon used for the fourth time, an invalid index is printed on the label Ra5 in Step 14 and the processing goes back to Step 12 to reduce the ribbon winding back amount again and repeat the verifying of the recorded content.

When no defect is detected in a given number of labels which is necessary for recording a given length thereon uniformly, i.e., 5 labels in case of 80% ribbon winding back amount and 10 labels in case of 90% ribbon winding back amount, the processing advances to Step 2 for next recording process.

Although the defectively recorded label can be produced also by the line breakage of the thermal head, it can be prevented by performing a line breakage check before the recording operation without resorting to the verifying of the recorded contents according to the invention.

Figure 19:
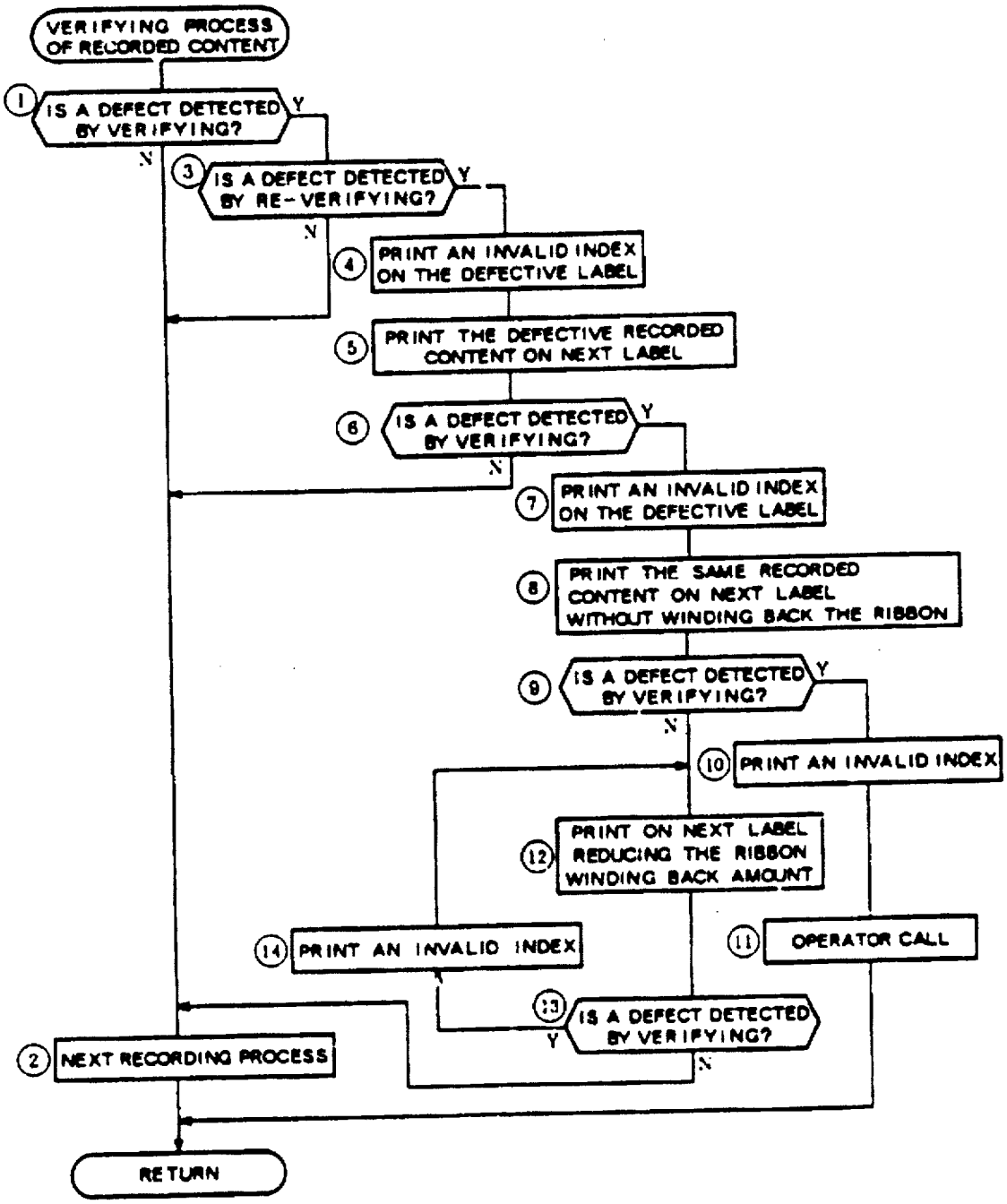
FIG. 19 is a flowchart showing a routine relating to the verifying process of the recorded content performed by the control portion of the printer in FIG. 11.
Figure 20A:
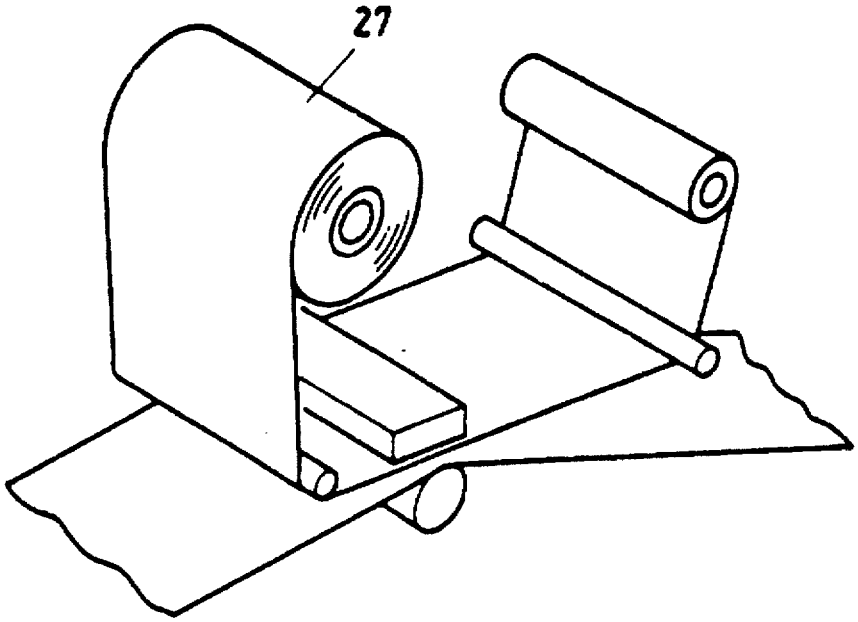
FIG. 20A PRIOR ART
FIGS. 20*a* and 20*b* are perspective views respectively showing a neatly rolled up ribbon and a conically rolled up ribbon which has been gradually shifted to one side of a spool as it is rolled round the spool.
Figure 20B:
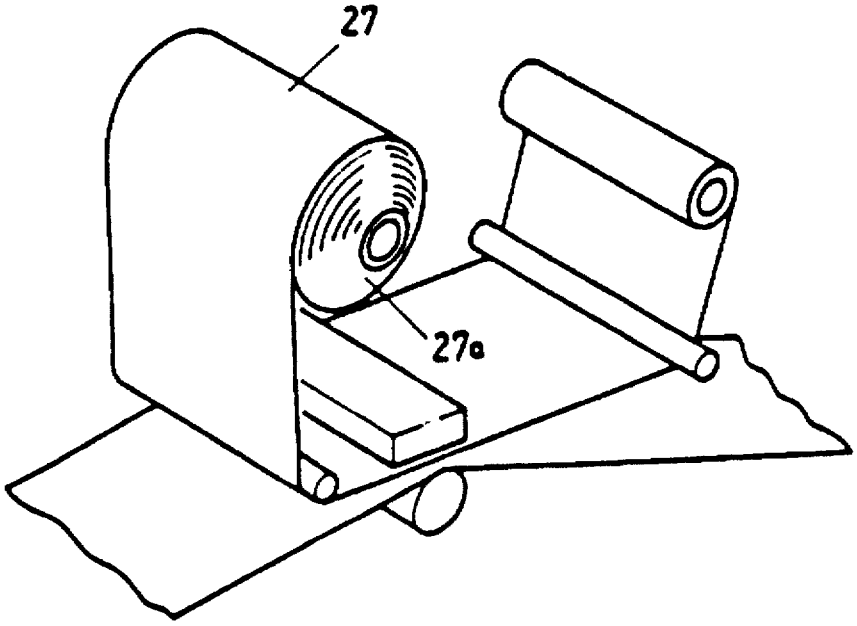
FIG. 20B PRIOR ART

It is also recommendable to display the ribbon winding back amount which is newly set in Step 12 in FIG. 19 by numerals 0 to 15 corresponding to the scale of the rotary SW 47, for example, using four LEDs.

In that case if the rotary SW 47 is reset to correspond to the numerals displayed on the display means when the printer is turned off, it is convenient since the proper ribbon winding back amount is set from the start when the printer is turned on again.

It is also recommendable to make the printed invalid index after the ribbon winding back amount is changed as described in Step 14 in FIG. 19 different from those in Steps 4, 7 and 10.

It is because the defect detected by the verifying in Step 13 is fundamentally different in cause from those in Steps 1, 3, 6 and 9 described above.

Accordingly, if it is marked by an invalid index different from other indices, it serves as a very effective information since it can be easily identified in case of investigating defective labels etc. later.

As examples of the invalid indices different from others, various methods can be considered such as forming a plurality of invalid indices, providing another stamper which is different in shape from the stamper 77 and the like.

Moreover in case the defect is detected in Step 13, it is caused by an improper setting of the ribbon winding back amount, and if it is detected during a continuous printing, for example, it can be considered to be due to the variation of environmental temperature, which has caused the variation of plasticity of the ribbon and consequently the variation of the ribbon winding back amount.

As a result, since the recorded content is different from the former ones, it is recommendable to make the printed invalid index different from other ones and inform the operator of the defect by buzzer etc. when the invalid index is printed on the label to leave it to his judgment.

The defect detected in Step 13 is fundamentally caused by the excessive winding back amount of the ribbon and it is detected as a result of verifying during the repeated printing of the content which is necessary to be uniformly printed by a given length with the set ribbon winding back amount.

Accordingly, the defect is liable to be detected no more by changing the scanning path, so that the invalid index should be printed only when re-verifying (verifying by re-scanning) nevertheless detects the defect without instantly printing the invalid index even if the printed content is decided to have a defect in Step 13.

Although the flowchart in FIG. 19 exemplifies a case where the verifying is performed five times successively in Steps 1, 3, 6, 9 and 13, the combination (order) of the verifying operations may be arbitrarily set in accordance with the whole system to be a maximal combination, and it is convenient to sound an operator call when necessary.

Moreover, according to this embodiment, the main control portion 40 illustrated in FIG. 18 functions as a re-recording control means for re-recording the same symbol in the next recording portion of a recording medium by a recording means (thermal head 2) when the verifying means (the verifying unit 50) detects a defect in the recorded content as a result of verifying.

Furthermore, the main control portion 40 also functions as a transfer medium normal direction conveying re-recording control means which stops reversely conveying the transfer medium by the transfer medium conveying means set forth above based on the reversely conveying amount information of the transfer medium reversely conveying amount information management means (the ribbon winding back motor control portion 46) to convey the transfer medium only in the normal direction for recording the same symbol again in the next recording portion of the recording medium when the verifying means detects a defect in the recorded content as a result of verifying.

Still furthermore, the main control portion 40 also functions as the transfer medium reverse direction conveying amount variation recording control means for reducing the reverse direction conveying amount of the above transfer medium which is an information managed by the above transfer medium reversely conveying amount information management means when the verifying means does not detect any defect as a result of verifying in the content re-recorded by the above transfer medium normal direction conveying re-recording control means so as to record symbols on the following recording medium by the recording means while winding back to the transfer medium by the varied reverse direction conveying amount by the above transfer medium conveying means during the conveyance thereof in the normal direction.

Still furthermore, the main control portion 40 also functions as a transfer medium reverse direction conveying amount gradually reducing adjustment means for repeatedly reducing the reverse direction conveying amount of the transfer medium which is an information managed by the above transfer medium reversely conveying amount information management means until no defect is detected when the verifying means detects a defect in the recorded content of a symbol which is recorded under the control of the transfer medium reverse direction conveying amount variation recording control means.

Still furthermore, when the invalid index printed in Step 14 is made different from those printed in other Steps as described above, the main control portion 40 illustrated in FIG. 18 functions as an invalid index variation control means for forming an invalid index which is different in shape etc. from the preceding ones on the recording medium by way of the invalid index forming means (void stamper 70) when the verifying means detects a defect in the recorded content of a symbol which has been recorded on the recording medium while conveying the transfer medium in the reverse direction by the varied reverse direction conveying amount every time a unit of printing is completed during the normal direction conveyance thereof.

Finally the effect of the invention will be described hereinafter.

As described above, according to the invention, printing is performed by winding back a transfer medium in the reverse direction by a given amount based on a reversely conveying amount information every time printing on a sheet or a unit of several sheets of recording medium is completed and thereafter by conveying the transfer medium in the normal direction.

Accordingly, if a transfer medium capable of performing repeated printing using the same portion thereof such as a multi-pass thermal transfer ribbon, it can be used up to the limit so far as the print quality is allowable and consequently can be thrown away after all of it has passed the recording means, so that the transfer medium is improved in operability and workability.

Also in the printer equipped with the verifying means and the invalid index forming means as set forth above, a verifying is made whether there is a defect or not in a symbol such as a bar code etc. which is recognized by an electro-optical technology and in case the defect is detected therein, an invalid index can be formed thereon by printing etc., so that it is possible to accurately record a symbol such as a bar code etc. which is prevented from being unreadable or wrongly read when it is read by the electro-optical technology.

Moreover, there is the possibility of generating a defective bar code etc. due to the decrease of print quality such as print density etc. in case of a transfer medium such as the multi-pass thermal transfer ribbon which is repeatedly used at the same portion thereof for printing, but the printer according to the invention can be free from such apprehension.

What is claimed is:

1. A printer for printing on a recording medium using a transfer medium comprising:

a recording means for recording on said recording medium by supplying energy to said transfer medium;

a transfer medium reversely conveying amount information management means for managing the conveying amount information of said transfer medium in the direction reverse to the normal direction toward said recording means; and a transfer medium conveying means which conveys said transfer medium in said normal direction and reverse direction and conveys said transfer medium based on the reversely conveying amount information managed by said transfer medium reversely conveying amount information management means when said transfer medium is conveyed in the reverse direction, wherein the conveying amount of the transfer medium in the reverse direction is performed to an extent such that previously used portions of the transfer medium are conveyed past said recording means in the reverse direction.

2. A printer according to claim 1, characterized in that said transfer medium reversely conveying amount information management means is composed of:

a transfer medium normal direction conveying amount measuring means for measuring the conveying amount of said transfer medium which is conveyed in said normal direction to be used in performing said recording process by said recording means;

a transfer medium reverse direction conveying ratio setting means for setting the reverse direction conveying ratio of said transfer medium to the used length of said transfer medium; and a transfer medium reverse direction conveying amount control means for controlling the conveying amount of said transfer medium in said reverse direction based on a value set by said transfer medium reverse direction conveying ratio setting means and the result of measurement of said transfer medium normal direction conveying amount measuring means.

3. A printer according to claim 2, characterized in that said transfer medium normal direction conveying amount measuring means is composed of a transfer medium supply spool rotating amount measuring means for measuring the rotating amount of the supply spool of said transfer medium or the rotating amount of a member interlocked with said supply spool.

4. A printer according to claim 2, characterized in that said printer further comprises a test printing means for setting the transfer medium reverse direction conveying ratio which repeats a given length of printing on said recording medium by said printer and conveying said transfer medium in said reverse direction by a given ratio to a given length of said transfer medium which has been used for preceding printing in order to determine the setting value of said transfer medium reverse direction conveying ratio setting means.

5. A printer according to claim 1, wherein said recording medium is a multi-pass thermal transfer ribbon.

6. A printer according to claim 1, wherein up to 90% of the length of the transfer medium which has been subjected to said recording means is conveyed in the reverse direction.

7. A method of printing on a recording medium by a printer, the printer comprising:

a recording means for recording on said recording medium by supplying energy to said transfer medium;

a transfer medium reversely conveying amount information management means for managing the conveying amount information of said transfer medium in the direction reverse to the normal direction toward said recording means; and a transfer medium conveying means which conveys said transfer medium in said normal direction and reverse direction and conveys said transfer medium based on the reversely conveying amount information managed by said transfer medium reversely conveying amount information management means when said transfer medium is conveyed in the reverse direction, wherein the conveying amount of the transfer medium in the reverse direction is performed to an extent such that previously used portions of the transfer medium are conveyed past said recording means in the reverse direction, said method comprising repeating the steps of:

performing a given length of printing by said recording means on said recording medium which is conveyed in said normal direction while conveying said transfer medium in said normal direction by said transfer medium conveying means;

then conveying said transfer medium in said reverse direction by said transfer medium conveying means according to a reversely conveying amount information managed by said transfer medium reversely conveying amount information management means; and thereafter performing said given length of printing on said recording medium while conveying said transfer medium in said normal direction again.

8. A method of printing according to claim 7, wherein said recording medium is a multi-pass thermal transfer ribbon.

9. A method of printing according to claim 7, wherein up to 90% of the length of the transfer medium which has been subjected to said recording means is conveyed in the reverse direction.

10. A printer comprising:

a recording means for recording a symbol on said recording medium by supplying energy to said transfer medium;

a transfer medium reversely conveying amount information management means for managing the conveying amount information of said transfer medium in the direction reverse to said normal direction toward said recording means; and a transfer medium conveying means which conveys said transfer medium in said normal direction and reverse direction and conveys said transfer medium based on said reversely conveying amount information managed by said transfer medium reversely conveying amount information management means when said transfer medium is conveyed in said reverse direction, said conveying amount of the transfer medium in the reverse direction being performed to an extent such that previously used portions of the transfer medium are conveyed past the recording means in the reverse direction;

a verifying means for verifying the content of said symbol recorded on said recording medium by said recording means; and an invalid index forming means for forming an invalid index on said recording medium where said verifying means detects a defect in said recorded content.

11. A printer according to claim 10, characterized in that said verifying means comprises a re-verifying means for re-verifying the same recorded content changing a scanning path when said verifying means detects a defect in said recorded content as a result of verifying.

12. A printer according to claim 10, characterized in that said printer further comprises a re-recording control means for recording the same symbol again in the next recording portion of said recording medium when said verifying means detects a defect in said recorded content as a result of verifying.

13. A printer according to claim 10, characterized in that said printer further comprises a transfer medium normal direction conveying re-recording control means which stops reversely conveying said transfer medium by said transfer medium conveying means based on said reversely conveying amount information of said transfer medium reversely conveying amount information management means to convey said transfer medium only in the normal direction for recording the same symbol again on the next recording portion of said recording medium when said verifying means detects a defect in the recorded content as a result of verifying.

14. A printer according to claim 13, characterized in that said printer further comprises a transfer medium reverse direction conveying amount variation recording control means for reducing the reverse direction conveying amount of said transfer medium which is an information managed by said transfer medium reversely conveying amount information management means when said verifying means does not detect any defect as a result of verifying in the content recorded again by said transfer medium normal direction conveying re-recording control means so as to record symbols on the following recording medium conveyed thereafter by said recording means while winding back said transfer medium by the varied reverse direction conveying amount during the conveyance thereof in the normal direction by said transfer medium conveying means.

15. A printer according to claim 14, characterized in that said printer further comprises a transfer medium reversely conveying amount gradually reducing adjustment means for repeatedly reducing the reverse amount of said transfer medium which is an information managed by said transfer medium reversely conveying amount information management means until no defect is detected when said verifying means detects a defect in the content of a symbol which is recorded under the control of said transfer medium reverse direction conveying amount variation recording control means.

16. A printer according to claim 14, characterized in that said printer further comprises an invalid index variation control means for forming an invalid index which is different from the preceding ones on said recording medium by way of said invalid index forming means when said verifying means detects a defect in the content of a symbol recorded on said recording medium while conveying said transfer medium in the reverse direction by the varied reverse direction conveying amount every time a unit of printing is completed during the normal direction conveyance thereof.

17. A printer according to claim 10, wherein said recording medium is a multi-pass thermal transfer ribbon.

18. A printer according to claim 10, wherein up to 90% of the length of the transfer medium which has been subjected to said recording means is conveyed in the reverse direction.

* * * * *

UNITED STATES PATENT AND TRADEMARK OFFICE

CERTIFICATE OF CORRECTION

PATENT NO. : 5,700,096
DATED : December 23, 1997
INVENTOR(S) : SATOH et al.

It is certified that error appears in the above-indentified patent and that said Letters Patent is hereby corrected as shown below:

In Claim 1 on lines 51-52 in column 20, "previously used portions of the transfer medium are conveyed past said recording means" should be --up to 90% of the length of the transfer medium which has been subjected to said recording means is conveyed--.

Delete Claim 6

In Claim 10 on lines 19-20 in column 22, "previously used portions of the transfer medium are conveyed past the recording means" should be --up to 90% of the length of the transfer medium which has been subjected to said recording means is conveyed--.

Delete Claim 18

Signed and Sealed this

Twenty-fifth Day of August, 1998

Bruce Lehman

*Attest:*

BRUCE LEHMAN

*Attesting Officer*

*Commissioner of Patents and Trademarks*